US006510670B1

(12) United States Patent
Janhonen

(10) Patent No.: US 6,510,670 B1
(45) Date of Patent: Jan. 28, 2003

(54) PACKAGING APPARATUS AND METHOD FOR WRAPPING FLAT ARTICLES, SUCH AS BOOKS

(75) Inventor: Tarmo Janhonen, Helsinki (FI)

(73) Assignee: Pussikeskus Oy, Helsinki (FI)

( * ) Notice: Subject to any disclaimer, the term of this patent is extended or adjusted under 35 U.S.C. 154(b) by 0 days.

(21) Appl. No.: 09/559,502

(22) Filed: Apr. 27, 2000

(30) Foreign Application Priority Data

Apr. 30, 1999 (FI) ..... 990985

(51) Int. Cl.[7] ..... B65B 11/00

(52) U.S. Cl. ..... 53/209; 53/55; 53/504; 53/564; 271/227; 271/240

(58) Field of Search ..... 53/207, 208, 209, 53/218, 230, 51, 52, 55, 382.1, 504, 564; 271/226, 227, 228, 236, 238, 240, 241; 493/477, 478, 479

(56) References Cited

U.S. PATENT DOCUMENTS 2,935,832 A * 5/1960 Mischke ..... 53/381.1
3,626,660 A * 12/1971 Dorfmann ..... 53/209
3,716,962 A * 2/1973 Langen et al. ..... 53/209
4,091,596 A * 5/1978 Jones ..... 53/209
4,449,351 A * 5/1984 Henderson ..... 53/382.1
4,657,239 A * 4/1987 Ikesue et al. ..... 271/240
4,674,261 A * 6/1987 Sabel ..... 53/564
4,757,666 A * 7/1988 Janhonen ..... 53/218
4,972,653 A 11/1990 Janhonen ..... 53/504
4,982,552 A * 1/1991 Odenthal ..... 53/207
5,056,294 A * 10/1991 Focke ..... 53/230
5,127,207 A * 7/1992 Cunningham ..... 53/389.1
5,172,138 A * 12/1992 Okazawa et al. ..... 271/240
5,197,260 A * 3/1993 Chevalier et al. ..... 53/209
5,294,108 A * 3/1994 Pollich et al. ..... 271/241
5,299,410 A * 4/1994 Freeman ..... 53/504
6,264,196 B1 * 7/2001 Lotsch ..... 271/226
6,363,690 B1 * 4/2002 Lay et al. ..... 53/504

* cited by examiner

*Primary Examiner*—John Sipos
*Assistant Examiner*—Louis Huynh
(74) *Attorney, Agent, or Firm*—Price, Heneveld, Cooper, DeWitt & Litton

(57) ABSTRACT

The invention relates to a packaging apparatus for wrapping flat articles, such as books, in a cardboard-made flat package blank, including first flaps remaining on the inside and second flaps remaining on the outside. The packaging apparatus comprises a supply station for package blanks, including alignment and centering elements for a bundle of package blanks and feed means for delivering the blanks from the bundle one by one onto a packaging line, an opening mechanism for the inner flaps of package blanks, a supply station for feeding one or more articles, or a consignment, onto each package blank, means for folding and bending the inner flaps around the consignment means for turning the package blank through 90° relative to its advancing direction, and means for folding and bending the outer flaps around the consignment on top of the inner flaps. The packaging apparatus is provided with first measuring elements capable of measuring the package blank for its width lateral to the travel direction. The first measuring elements are adapted, during the course of measuring, to perform also the alignment and centering for the bundle of blanks, and the first measuring elements produce a measuring result which is adapted to automatically control a distance between the walls included in the alignment and centering elements of the supply station. The invention relates also to a method for packaging flat articles.

12 Claims, 18 Drawing Sheets

PACKAGING APPARATUS AND METHOD FOR WRAPPING FLAT ARTICLES, SUCH AS BOOKS

BACKGROUND OF THE INVENTION

The present invention relates to a packaging apparatus and a method for wrapping flat articles, such as books, in a package blank.

Patent publication U.S. Pat. No. 4,972,653 discloses a package closing machine, which is only suitable for closing the outer cardboard of a package, not for closing an inner wrapper. This prior known machine is not applicable to the automatic reception of varying-width package blanks, but, instead, necessitates manually performed positioning operations as soon as the width of a package blank changes.

Even in a general sense, the packaging machines are not applicable to the fluctuation of package blanks in terms of the size thereof, or to the varying size and number of books, without production breaks and re-settings.

SUMMARY OF THE INVENTION

The present invention relates to a packaging apparatus for wrapping flat articles, such as books, in a package blank which is a cardboard-made flat panel, including first flaps or inner flaps remaining on the inside in a finished package and second flaps or outer flaps remaining on the outside in a finished package, and said packaging apparatus comprising a supply station for package blanks, comprising means for aligning and centering a bundle of package blanks and feed means for delivering the blanks from the bundle one by one onto a packaging line, the aligning and centering means including walls present on the opposite sides of the bundle of blanks; an opening mechanism for the inner flaps of package blanks; a supply station for feeding one or more articles, or a consignment, onto each package blank; means for folding and bending the inner flaps around the consignment; means for turning the package blank through 90° relative to its advancing direction, and means for folding and bending the outer flaps around the consignment on top of the inner flaps in a bending direction transverse to that of the inner flaps.

The invention relates also to a method for wrapping flat articles, such as books, in a package blank which is a cardboard-made flat panel, including first flaps or inner flaps remaining on the inside in a finished package and second flaps or outer flaps remaining on the outside in a finished package, said method comprising the steps of feeding a bundle of blanks constituted by package blanks to a supply station for blanks; aligning and centering the bundle of blanks between vertical walls present at the supply station and laterally delimiting the bundle; delivering the blanks from the bundle one by one onto a packaging line; opening the inner flaps; feeding one or more articles, or a consignment, onto each blank; folding and bending the inner flaps around the consignment; and folding and bending the outer flaps around the consignment, on top of the inner flaps.

It is an object of the invention to provide a packaging apparatus and method of the above type, which are suitable for automatically receiving package blanks of a varying width, and whereby the wrapping can be performed automatically from start to finish, even if the dimensions of a consignment to be wrapped keep changing.

This object is achieved by means of a packaging apparatus of the invention, featuring the characteristics set forth in the annexed claim 1. Respectively, the object is achieved by means of a method, featuring the characteristics set forth in the annexed claim 5. The non-independent claims disclose preferred embodiments of the invention, which secure the completion of a wrapping process automatically and without production breaks, although the dimensions of package blanks and a consignment keep changing.

These and other features, advantages and objects of the present invention will be further understood and appreciated by those skilled in the art by reference to the following specification, claims and appended drawings.

BRIEF DESCRIPTION OF THE DRAWINGS

One exemplary embodiment of the invention will now be described in more detail with reference to the accompanying drawings, in which.

DETAILED DESCRIPTION OF THE PREFERRED EMBODIMENT

Figure 2:
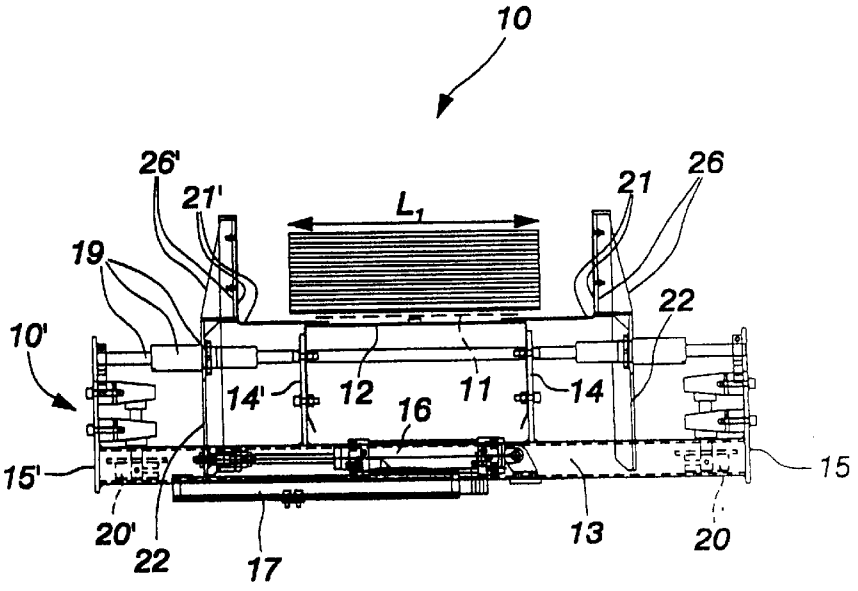
FIGS. 1, 2 and 3 show an alignment and centering station 10 for a packaging apparatus of the invention in elevation, direction of line, and plan view, respectively.
Figure 1:
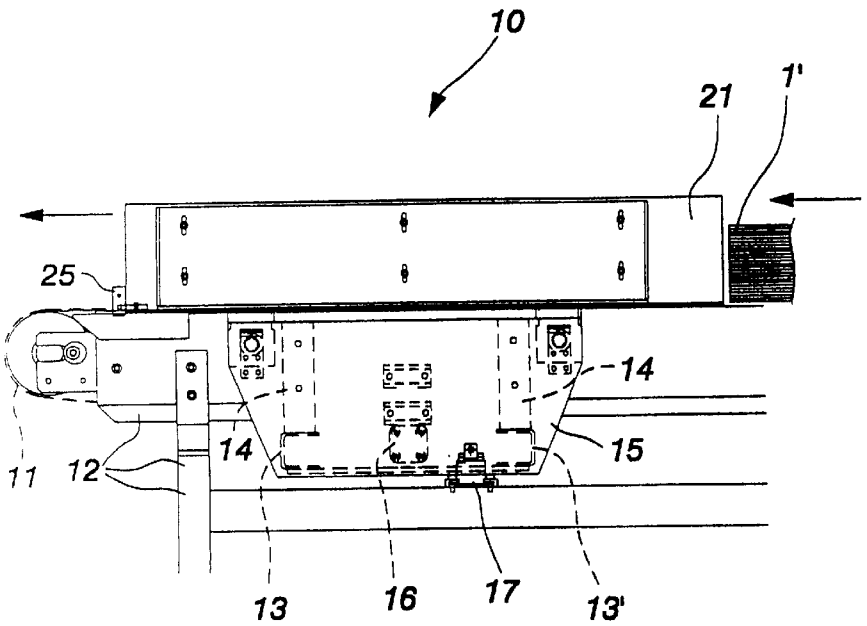
Figure 3:
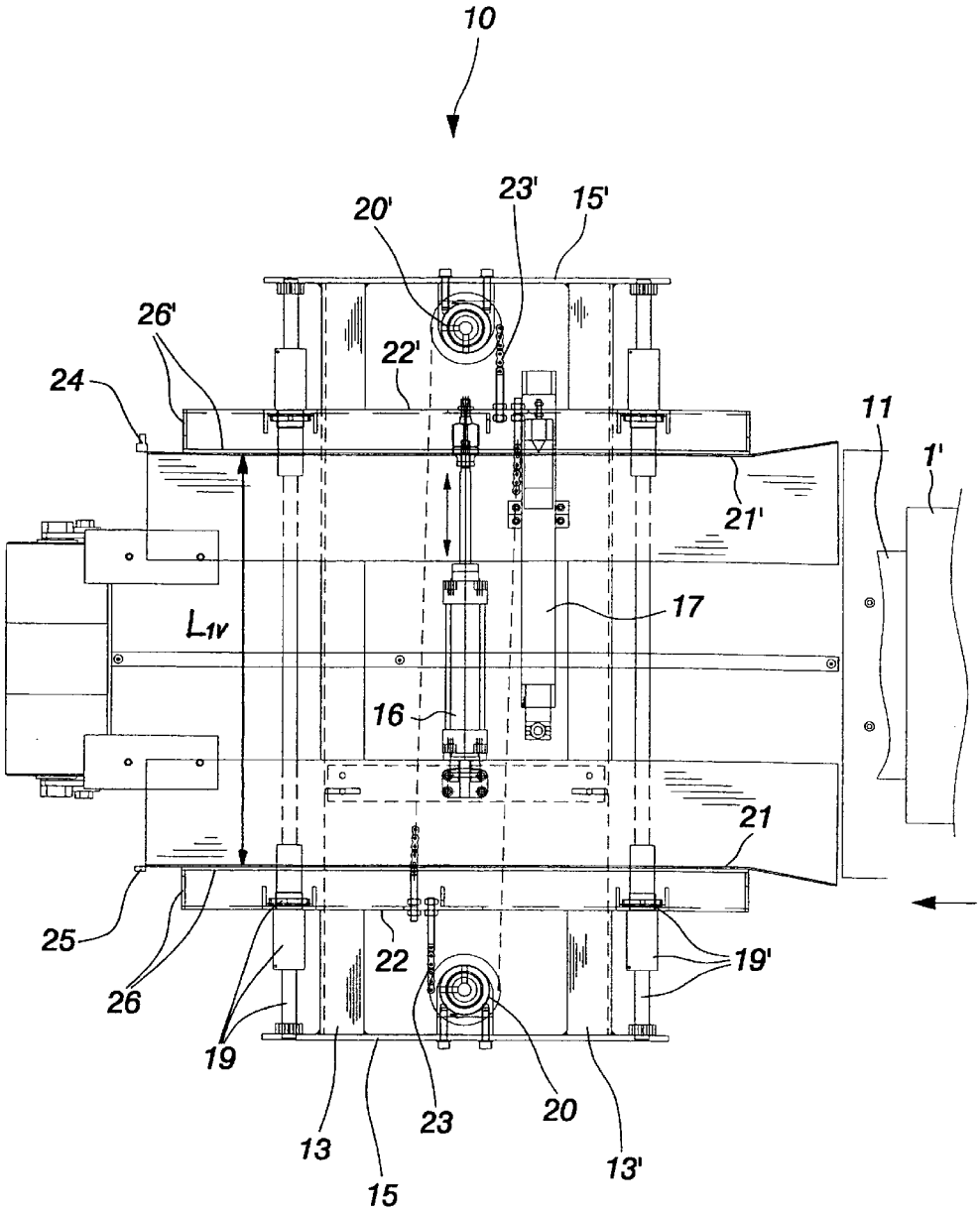

FIGS. 1, 2 and 3 illustrate an alignment and centering station 10 for bundles 1' of blanks. The bundle 1' of blanks is brought in alignment with the station 10 along a conveyor belt 11, which is adapted to advance between two vertical walls 21, 21' of the station 10. At the end of the vertical walls 21, 21' is a detector 24, 25 for detecting the leading edge of the bundle 1' of blanks received between the vertical walls 21, 21'. At this point, the conveyor belt 11 stops and the bundle 1' of blanks stops between the walls 21, 21'. The detector 24, 25 preferably comprises a transceiver 24 and a reflector 25.

Below the conveyor belt 11, in the vicinity of the vertical walls 21, 21', are elements 10' which accomplish movements of the walls 21, 21'. These movements enable the alignment and centering of package blanks 1 present in the bundle 1' of blanks, both relative to each other and relative to the conveyor belt 11. These elements 10' include an immobile, rigid frame member. The frame member is constituted by two spaced-apart abutment walls 15, 15' present on either side of the belt 11. The abutment walls 15, 15' are connected at the bottom portion thereof fixedly to each other by means of two preferably U-shaped crossbars 13, 13' transverse to the travel direction of the conveyor belt 11. The crossbars 13, 13' are provided with upward extending, plate-like upright struts 14, 14' for connecting the immobile frame member of the alignment and centering elements solidly to a conveyor belt housing 12.

Between the abutment walls 15, 15', on the top edges thereof are mounted slide bars 19, 19' along with slide bearings therefor. The slide bearings are mounted on partitions 22, 22' set on either side of the housing 12 of the conveyor belt 11, between the housing 12 and the abutment walls 15, 15'. Thus, with the assistance of slide bearings, the partitions 22, 22' travel along the slide bars 19, 19' to establish movable walls between the housing 12 of the conveyor belt 11 and the abutment walls 15, 15'. Consequently, the movable walls 22, 22' have a travel direction which is crosswise relative to the travel direction of the conveyor belt Between the movable wall 22 and the vertical wall 21, exactly like between the movable wall 22' and the vertical wall 21', is fitted a connecting partition wall 26, 26'. Thus, when the movable walls 22, 22' are traveling along the slide bars 19, 19', the vertical walls 21, 21' are also moving along with the movable walls 22, 22'.

The means responsible for the mobility of the vertical walls 21, 21' comprise a piston-rod equipped, preferably pneumatic cylinder 16, as well as a linear sensor 17 for measuring the position of the piston rod, which are arranged between the crossbars 13, 13' and located below the conveyor belt 11. The cylinder 16 and the linear sensor 17 are positioned transversely relative to the travel direction of the conveyor belt 11, such that the cylinder 16 has its piston-rod head attached to the bottom portion of the movable wall 22'. With the piston rod moving, as indicated by an arrow shown FIG. 3, crosswise relative to the travel direction of the conveyor belt 11, such that the cylinder 16 has its piston-rod head attached to the bottom portion of the movable wall 22'. With the piston rod moving, as indicated by an arrow shown in FIG. 3, crosswise relative to the travel direction of the conveyor belt, the movable walls 22, 22', as well as the vertical walls 21, 21', are also in motion.

A motion of the movable wall 22 (vertical wall 21) concurrent with that of the movable wall 22' (vertical wall 21') is accomplished preferably by means of sprockets 20, 20', as well as chains 23, 23' mounted on the abutment walls: 15, 15'. The chain 23 is attached by its first end to the movable wall 22 at the same level as the piston-rod head of the cylinder 16, and attached by its other end to the opposite movable wall 22', the chain 23 having its direction reversed by means of the sprocket 20 present at the same vertical level as the cylinder 16. The chain 23' is attached by its first end to the movable wall 22' at the same level as the piston-rod head of the cylinder 16, and attached by its other end to the opposite movable wall 22, the chain 23' having its direction reversed by means of the sprocket 20' present at the same vertical level as the cylinder 16. Thus, the chains 23, 23' subject the movable wall 22 to a pulling effect which is reverse to the direction of action of the piston rod of the cylinder 16. Consequently, the walls 22, 22' move symmetrically towards or away from each other. For example, when the cylinder is carrying the vertical wall 22' towards the abutment wall 15', the vertical wall 22 is simultaneously moving towards the abutment wall 15.

As the bundle 1' of package blanks lies stationary on the conveyor belt 11 between the vertical walls 21, 21', said vertical walls are moved by the action of the cylinder 16 against the opposite flanks of the bundle 1' of package blanks. The cylinder 16 has a motion force and time for its piston rod calculated in such a way that, as the vertical walls 21, 21' come to contact with the opposite flanks of the bundle 1' of package blanks, the action of the piston rod of the cylinder 16 essentially comes to a halt and presses, for the rest of the calculated motion time, the vertical walls 21, 21' against the opposite flanks of the bundle 1' of package blanks. Thus, the faces of the vertical walls 21, 21' have a distance $L_{1V}$ therebetween, which is substantially equal to what the identical package blanks 1 present in the bundle 1' of package blanks have as the lateral width $L_1$ thereof relative to the travel direction of the conveyor belt 11. The distance $L_{1V}$ between the faces of the vertical walls 21, 21' is preferably measured indirectly by means of the linear sensor or transducer 17 surveying the cylinder 16 with regard to the position of its piston rod.

After the calculated motion time as mentioned above has elapsed, the data regarding the cylinder 16 as for the position of its piston rod, i.e., the width $L_1$ of the bundle 1' of package blanks, is recorded and the motion force of the cylinder 16 is released for returning the piston rod of the cylinder 16, and hence the vertical walls 21, 21', to the original position. The location data of the sensor 17 about the position of the piston rod of the cylinder 16 is storable, e.g. in a programmable logic (not shown), used for controlling a system preferably as described both above and hereinbelow.

Figure 5:
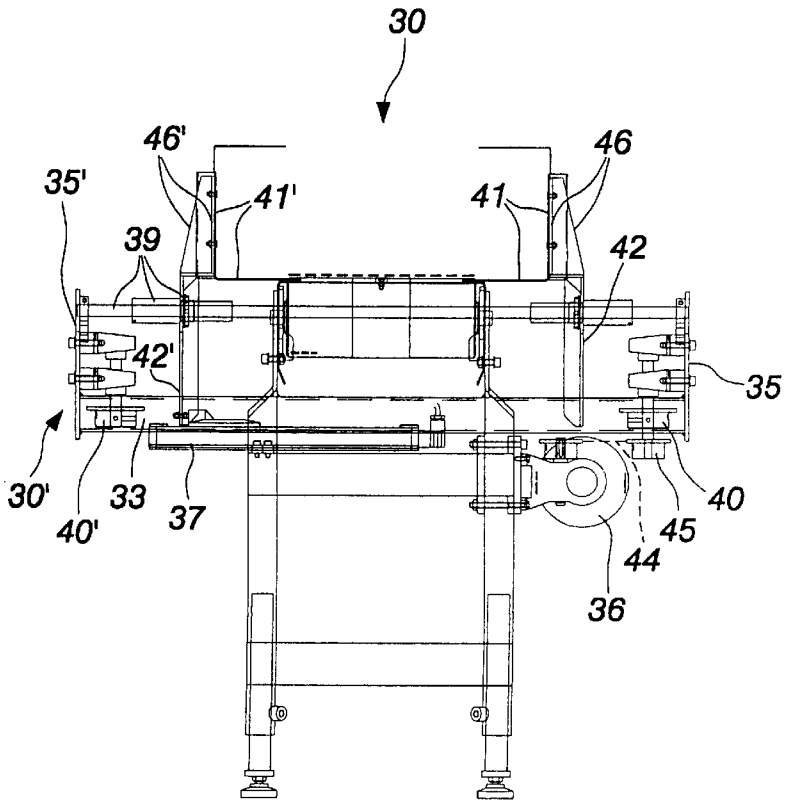
FIGS. 4, 5 and 6 show a supply station for package blanks in a packaging apparatus of the invention in elevation, direction of line, and plan view, respectively.
Figure 4:
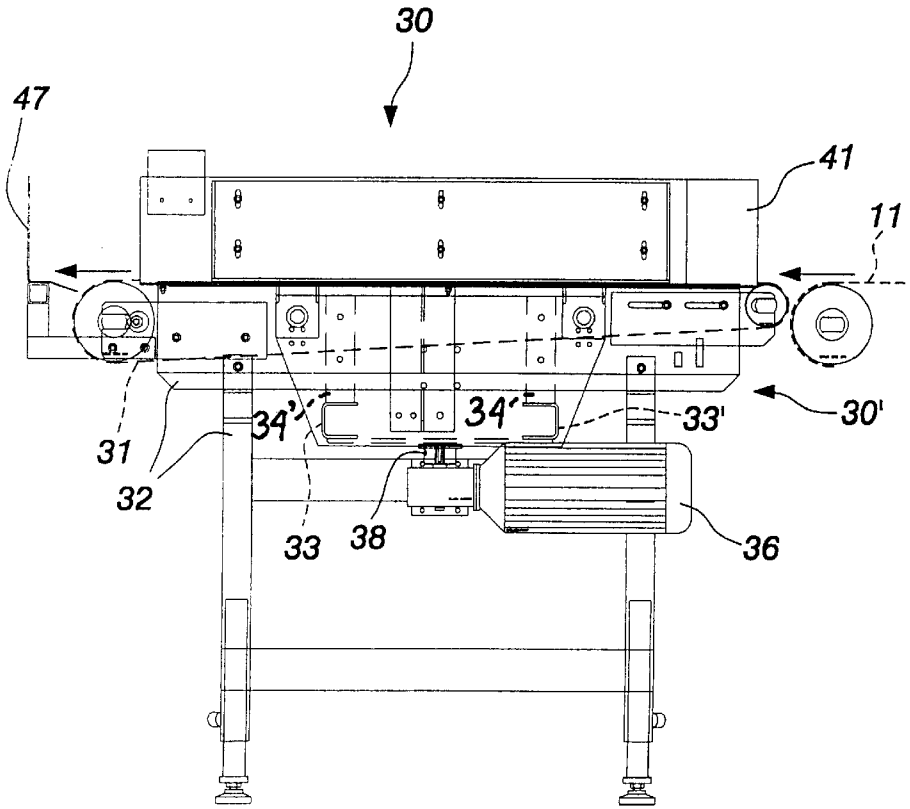
Figure 6:
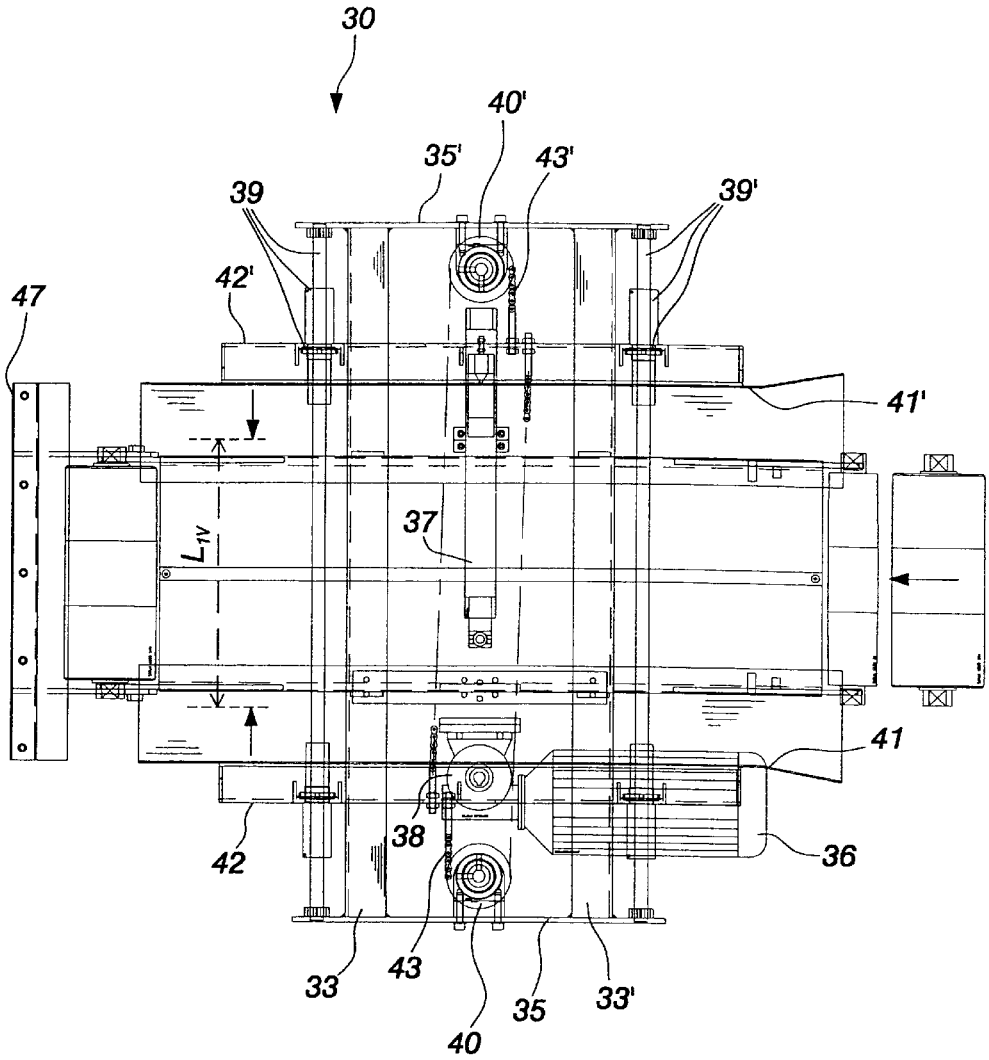

At this point the bundle 1' of package blanks is ready for a transfer to an actual supply station 30, depicted in FIGS. 4, 5 and 6. Preferably, the supply station 30 is structurally almost identical to the alignment and centering station 10. The supply station 30 is also provided with a conveyor belt 31, which is adapted to enter between two vertical walls 41, 41' of the station 30. The conveyor belt 31 has its trailing end provided with a vertical end wall 47, against which the package blanks 1 of the bundle 1' of package blanks align themselves in the travel direction of the conveyor belt 31. Below the conveyor belt 31, in the vicinity of the vertical walls, are elements 30' for performing alignment of the walls 41, 41'. These elements include an immobile, rigid frame member. The frame member is constituted by two spaced-apart abutment walls 35, 35' present on either side of the belt 31. The abutment walls 35, 35' are connected at the bottom portion thereof fixedly to each other by means of two preferably U-shaped crossbars 33, 33' transverse to the travel direction of the conveyor belt 31. The crossbars 33, 33' are provided with upward extending, plate-like upright struts 34, 34' for connecting the immobile frame member of the supply elements solidly to a housing 32 of the conveyor belt 31. The coincidental movements of the walls 41, 41' are achieved by a sprocket assembly similar to what is described above in connection with the alignment and centering station 10. The corresponding components included in this assembly are designated with reference numerals 40, 43, 40', 43', whereof 40, 40' represent sprockets and 43, 43' represent chains, respectively. The elements to accomplish a desired movement for the walls 41, 41' include a motor 36 and a linear transducer or sensor 37, fitted preferably underneath the sprocket 40. The motor 36 drives, for example through the intermediary of a belt 44, a pulley 45 which is in turn connected to the sprocket 40. Rotation of the sprocket 40 contributes to the movements of the chains 43, 43', secured by the ends thereof to walls 42, 42' and extending around the sprockets 40, 40', and further to the movements of the walls 41, 41'.

When the programmable logic receives information from the linear sensor 17 about the distance $L_{1V}$ between the walls 21, 21' of the alignment and centering station 10, the motor 36 begins at a proper moment to drive the sprockets 40, 41' of the adjustment station 30, whereby the walls 41, 41' presently in initial position begin to move relative to each other. This variation of distance is indirectly monitored by the linear sensor 37, which at this point monitors the movable wall 42' with regard to its position in a direction transverse to the travel direction of the conveyor belt 31. The logic compares the alteration of information received from the linear sensor 37 with information received from the linear sensor 17 about the distance between the vertical walls 21, 21'. The motor stops, i.e. the alteration of a distance between the walls 41, 41' stops, when the distance between the vertical walls of the supply station 30 becomes substantially equal (however, slightly larger than) to the distance $L_{1V}$ between the vertical walls 21, 21' of the alignment and centering station 10. The supply station 30 has its walls 41, 41' automatically guided to a correct position for receiving the bundle 1' of package blanks in the supply station 30. The bundle 1' of package blanks is carried from the alignment and centering station 10 to the supply station 30 along the conveyor belts 11 and 31. In its advancing direction, the bundle 1' of package blanks collides with an end wall 47 present at the downstream end of the conveyor belt 31.

Figure 7:
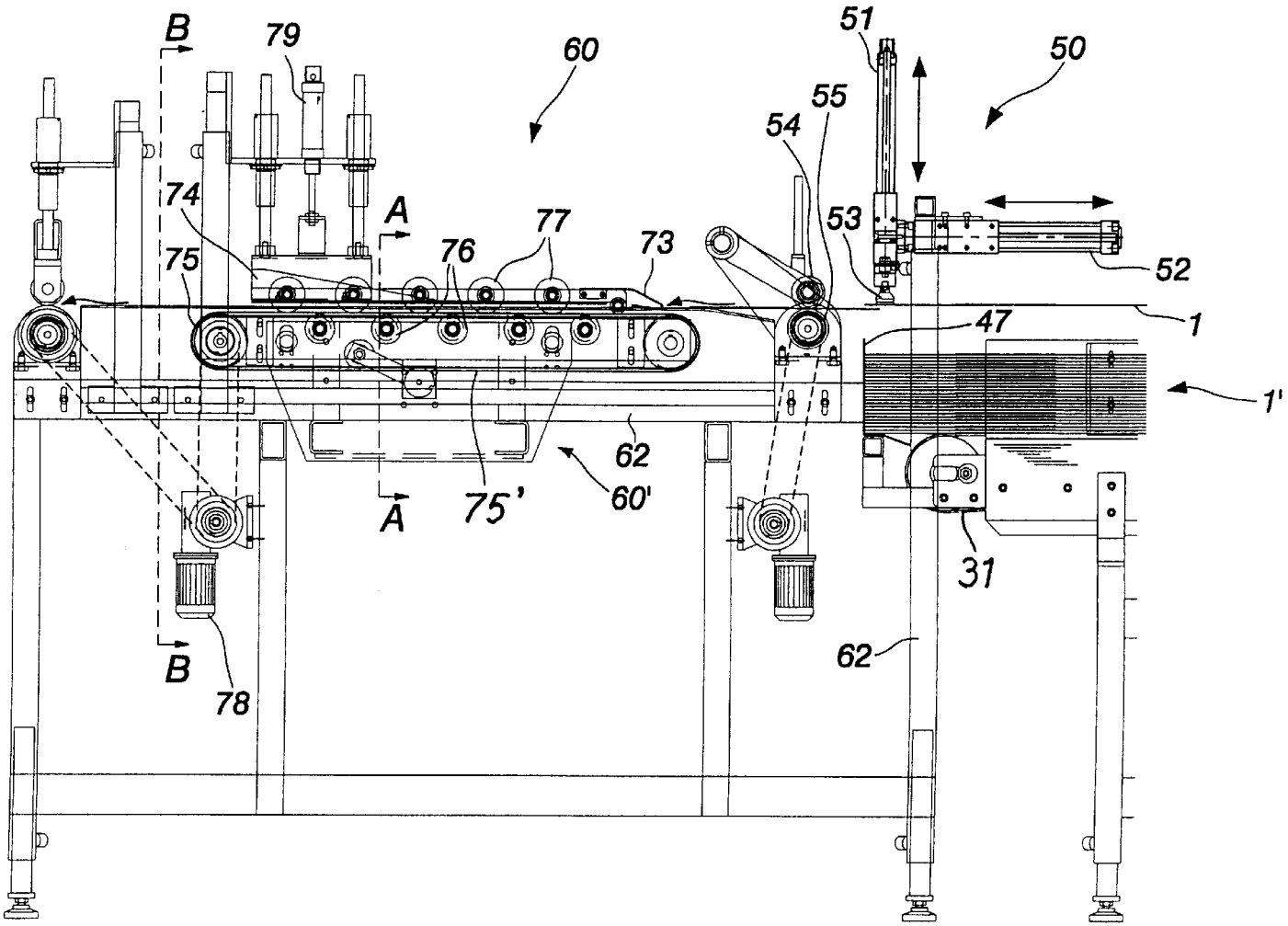
FIG. 7 shows in side view a feeding mechanism 50 in the packaging apparatus and an opening station 60 for inner flaps.

The supply station 30 includes an actual feeding mechanism 50, the design of which is shown in FIG. 7. The feeding mechanism 50 comprises elements 51 and 52, which are mounted on a frame 62 of an opening station 60 for inner flaps 2 and 3 (FIG. 24) and enable vertical and horizontal maneuvering, and which are preferably constituted by vertically and horizontally mounted slide bars or guides. The vertical guide 51 has its bottom end provided with a grabber 53, preferably a suction pad. There may be several suction pads, for example side by side.

The feeding mechanism 50 has its vertical guide 51 stationed above the uppermost package blank in the bundle 1' of package blanks set in alignment at the downstream end of the conveyor belt 31, essentially above one 4 of the outer flaps. The grabber 52 carried by the guide 51 is descended until it grabs a hold of the surface of the package blank 1. The suction pad 53, along with the blank 1, can be hoisted back up to a desired height along the guide 51 and carried, as shown in FIG. 7, laterally to the left by means of lateral guides 52 in between rollers 54, 55. At this point, the grabber 53 releases its hold of the surface of the blank 1, whereby the blank 1 advances from between the rollers 54, 55 to the opening station 60 for the inner flaps 2 and 3 of the blanks 1. The opening station 60 for the inner flaps 2 and 3 of the blanks 1 has its basic configuration depicted in FIGS. 7, 8 and 9, and it is described hereinafter with reference to these figures.

Figure 8:
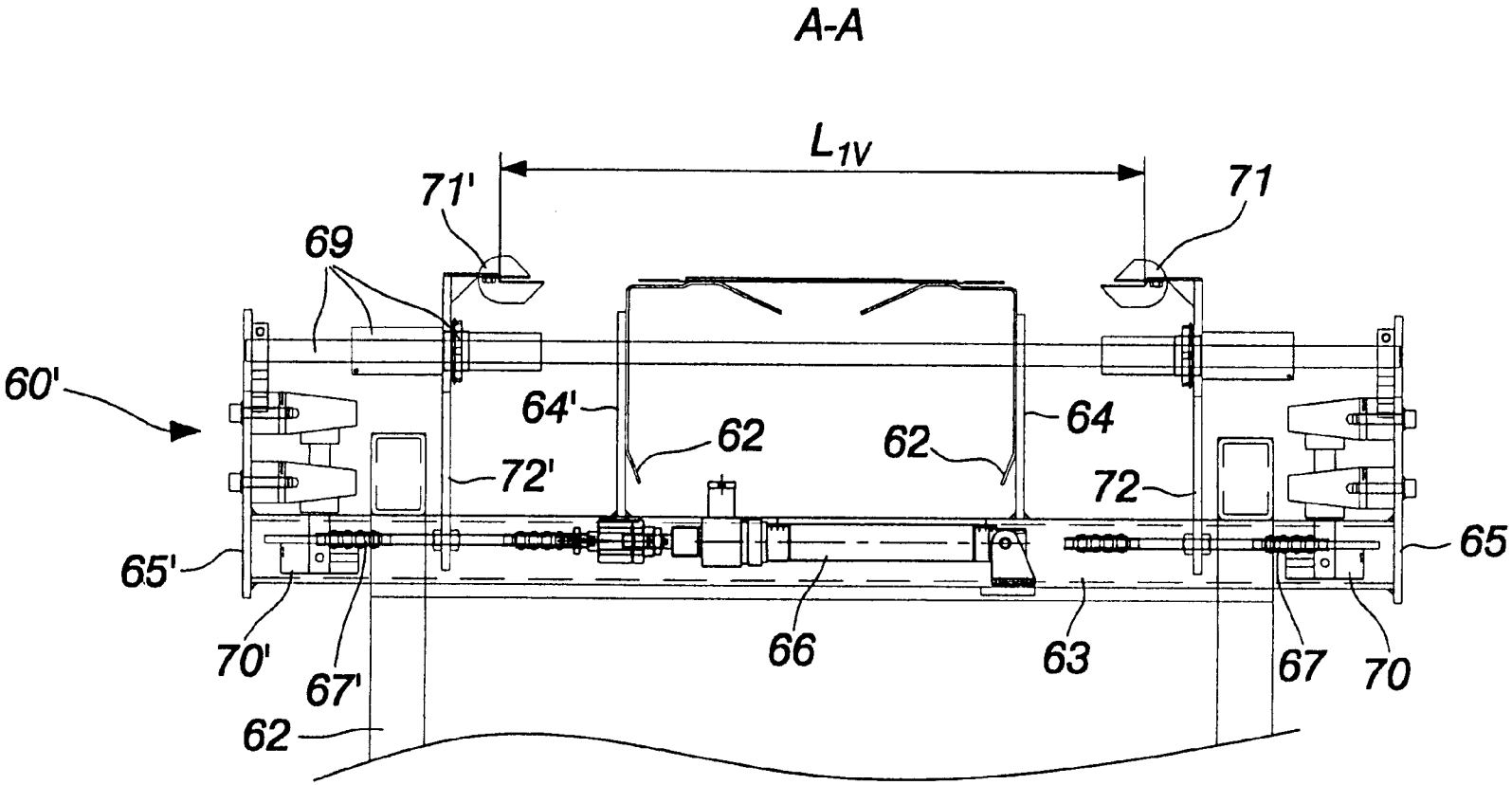
FIG. 8 shows a section taken along a line A—A in FIG. 7 (but without rollers 76, 77)

The opening station 60 for the inner flaps 2 and 3 comprises a roller assembly with top rollers 77 and bottom rollers 76, between which the package blank 1 progresses within the opening station 60. The opening station 60 is also provided with guides 71, 71' for side edges 7 and 8 (see FIG. 24) of the package blank 1 for the proper alignment of a single package blank 1 in between the rollers 76 and 77. Naturally, a distance $L_{1V}$ between the guides 71, 71' can be adjusted to match the width $L_1$ of the package blank 1. This is accomplished by means of elements 60' arranged below the roller assembly. The adjustment elements 60' arranged have a basic design which is identical to that of the adjustment elements for the vertical walls 21, 21' of the alignment and centering station 10. In other words, the adjustment elements include abutment walls 65, 65', having crossbars 63, 63' fitted therebetween for linking the abutment walls 65, 65' rigidly to each other. The crossbars 63, 63' are fitted with upright struts 64, 64', which are rigidly secured to the frame member 62 of the opening station 60. Between the abutment walls 65, 65', in the upper portion thereof, extend slide bars 69 carrying on either side thereof slide-journalled movable walls 72, 72'. The upper portion thereof is fitted with the guides 71, 71', between which the package blank 1 is adapted to move. The coincidental lateral movement of the guides 71, 71' is accomplished the same way as described in connection with the alignment and centering station 10. The respective elements are illustrated in FIG. 8 with reference numerals 70, 70', 67, 67' (sprockets and chains). The movement of the movable walls 72, 72' is achieved by means of a cylinder 66, having the end of its piston rod attached to the bottom part of the second movable wall 72', while the sprocket assembly accomplishes the coincidental movement of the walls 72, 72' (guides 71, 71') towards or away from each other.

As described in reference to the station 10, the opening station 60 is also set in connection with a linear sensor (not shown) for monitoring the cylinder 66 as regards the position of its piston rod, i.e., a distance between the guides 71, 71'. The correct distance between the guides 71, 71' is accomplished in such a way that, as the logic receives information about the width $L_1$ of the next bundle 1' of package blanks from the linear sensor 17 of the station 10, the cylinder 66 of the opening station 60 has its piston rod moving at a given moment, such that said linear sensor of the opening station 60 monitors continuously the position of the piston rod, or the distance between the guides 71, 71'. This change of position is compared with information received from the sensor 17 about the position of the cylinder 16, or about the distance $L_{1V}$ between the vertical walls 21, 21', until a match is reached therebetween. At this point, the cylinder 66 stops and remains stationary, the remaining distance $L_{1V}$ between the guides 71, 71' matching that between the vertical walls 21, 21' of the station 10. Thus, the opening station 60 is ready to receive a single package blank 1.

Figure 9:
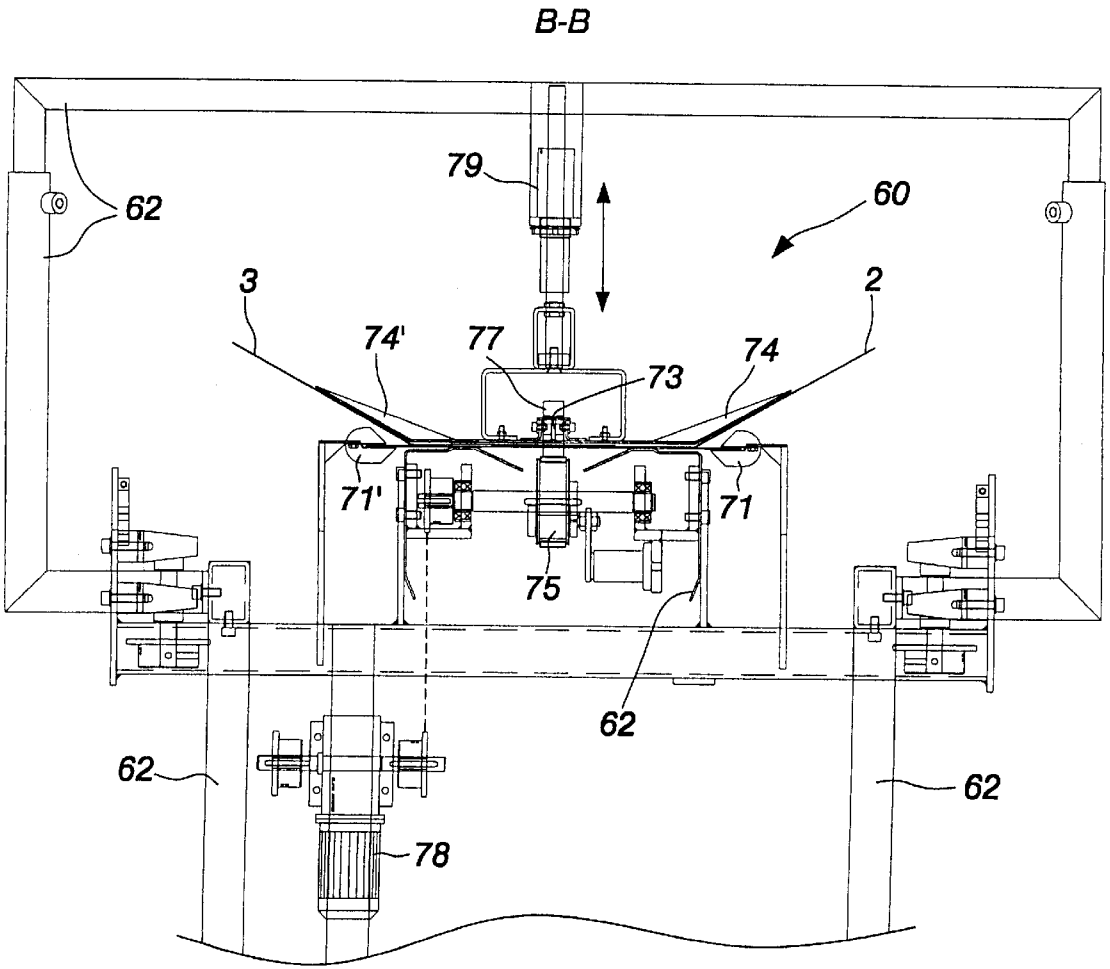
FIG. 9 shows a section taken along a line B—B in FIG. 7.

The roller assembly has its design depicted in FIGS. 7 and 9. The roller assembly preferably comprises a vertical cylinder 79 or the like, mounted on the skeleton of its frame element 62, the end of its piston rod being provided with top rollers 77 in succession lengthwise of the opening station 60. On either side of the top rollers 77, to be carried along with the piston rod, there are provided panel-like expanders 74, 74' for the inner flaps 2 and 3, extending gently upwards in directions opposite to each other, the roller assembly comprises also a conveyor belt 75', as well as bottom rollers 76 rotating along with the conveyor belt. The conveyor belt 75' is driven through the intermediary of a motor 78.

Figure 24:
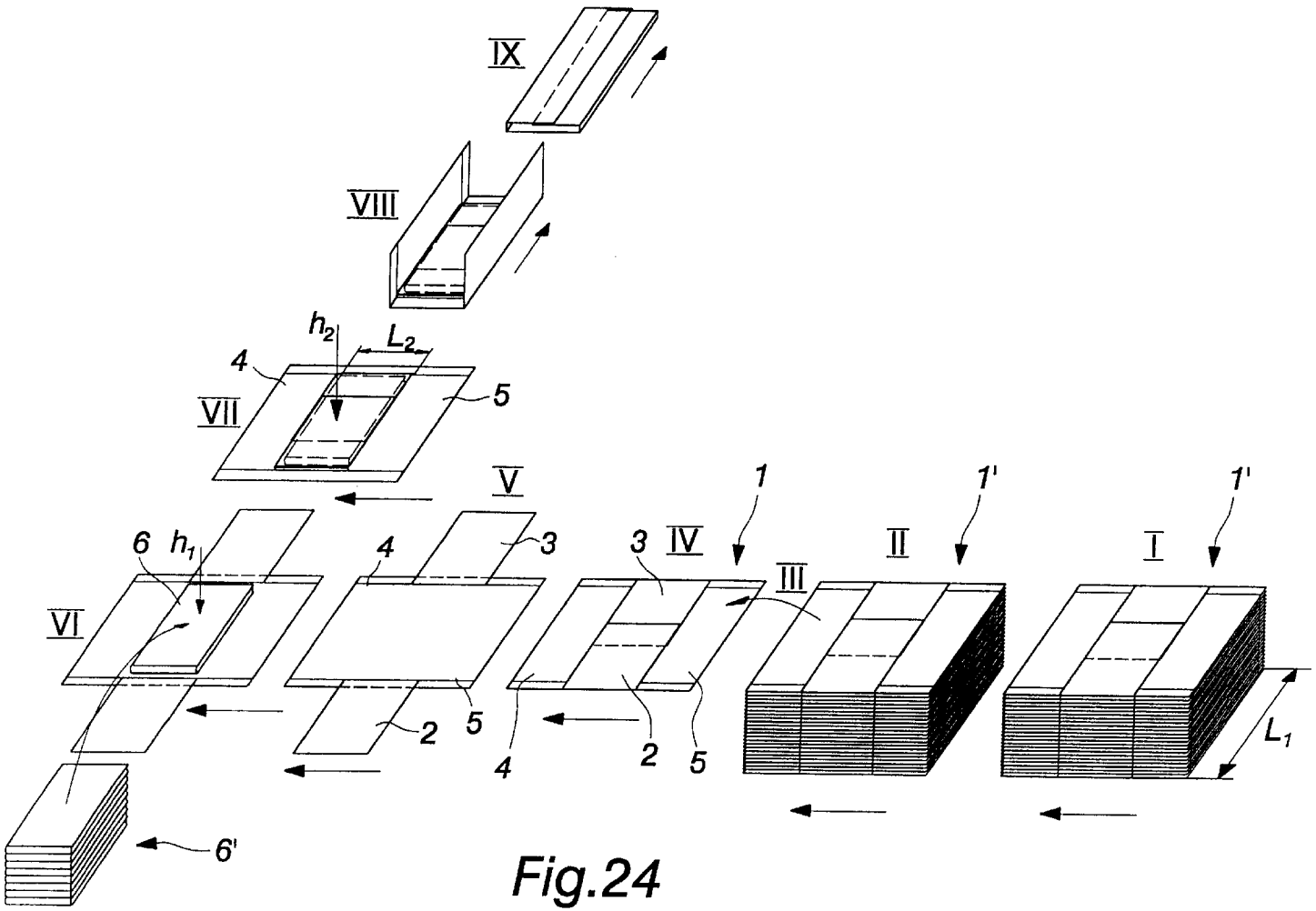
FIG. 24 shows various processes I-IX in the progress of a packaging method implemented by using a packaging apparatus of the invention.

As the package blank 1 is delivered through rotating rollers 54, 55 to the opening station 60, a curb piece 73 works its way underneath the inner flaps 2 and 3 and on top of the outer flaps 4 and 5 of the package blank 1, such that the inner flaps 2 and 3 lying on top of the outer flaps 4 and 5 of the package blank 1 become half-way unfolded. At the same time, the package blank 1 is diverted laterally in between the guides 71, 71' in such a way that the package blank 1 has its side edge 7 sliding within a slot constituted by the guide 71 and the package blank 1 has its side edge 8 sliding within a slot constituted by the guide 71'. Thereafter, the package blank 1 transfers onto the belt 75' driven by pulleys 75, as well as onto the bottom rollers 76 driven by the belt, the top rollers 77 provided on the piston rod of a cylinder 79 being transferred onto the package blank 1, such that the package blank 1 is movable between the belt 75' and the top rollers 77. As the package blank 1 is progressing, the expanders 74, 74' of the inner flaps 2 and 3 open the inner flaps 2 and 3 more and more, as shown in FIG. 9. By the time the package blank 1 has ultimately passed the rollers 76, 77 of the opening station 60, the blank 1 has its inner flaps 2 and 3 opened to the position shown at V in FIG. 24. At this point, the package blank 1 is ready for a transfer onto the supply line for a consignment 6. FIG. 24 depicts a pile 6' of articles, from which the consignment can be placed onto the package blank 1 manually or mechanically from an automated supply line.

Figure 11:
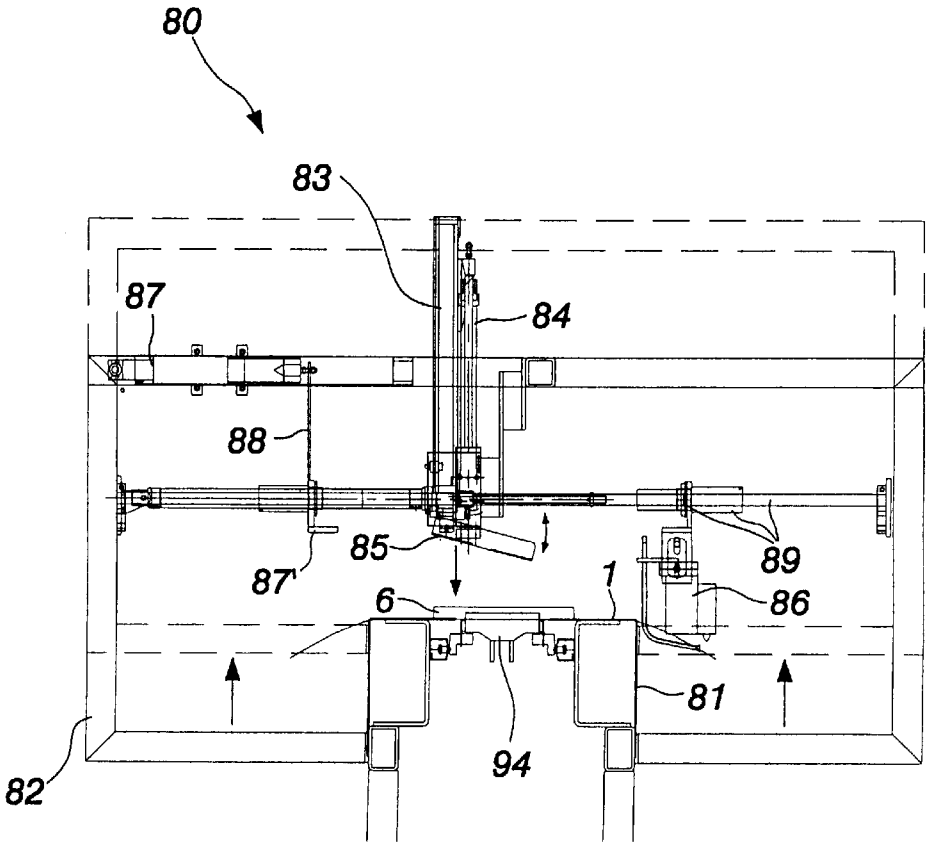
FIGS. 10, 11 and 12 show a measuring station 80 for a package blank in terms of its height and the position of its side wall, in elevation, direction of line, and plan view, respectively.
Figure 10:
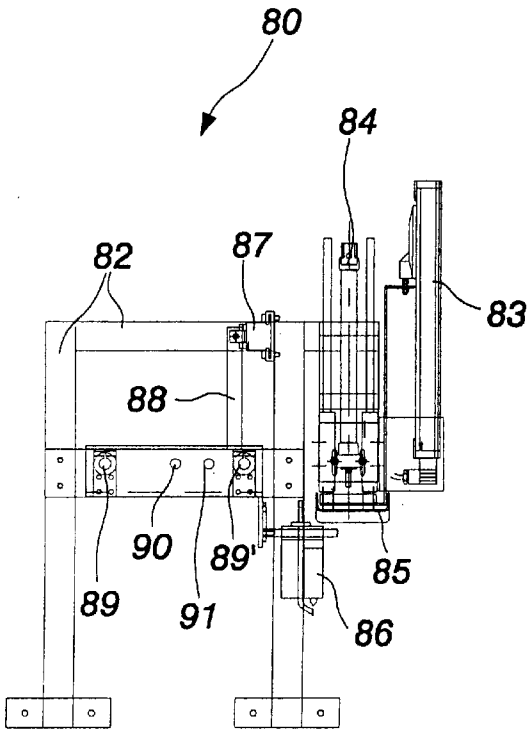
Figure 12:
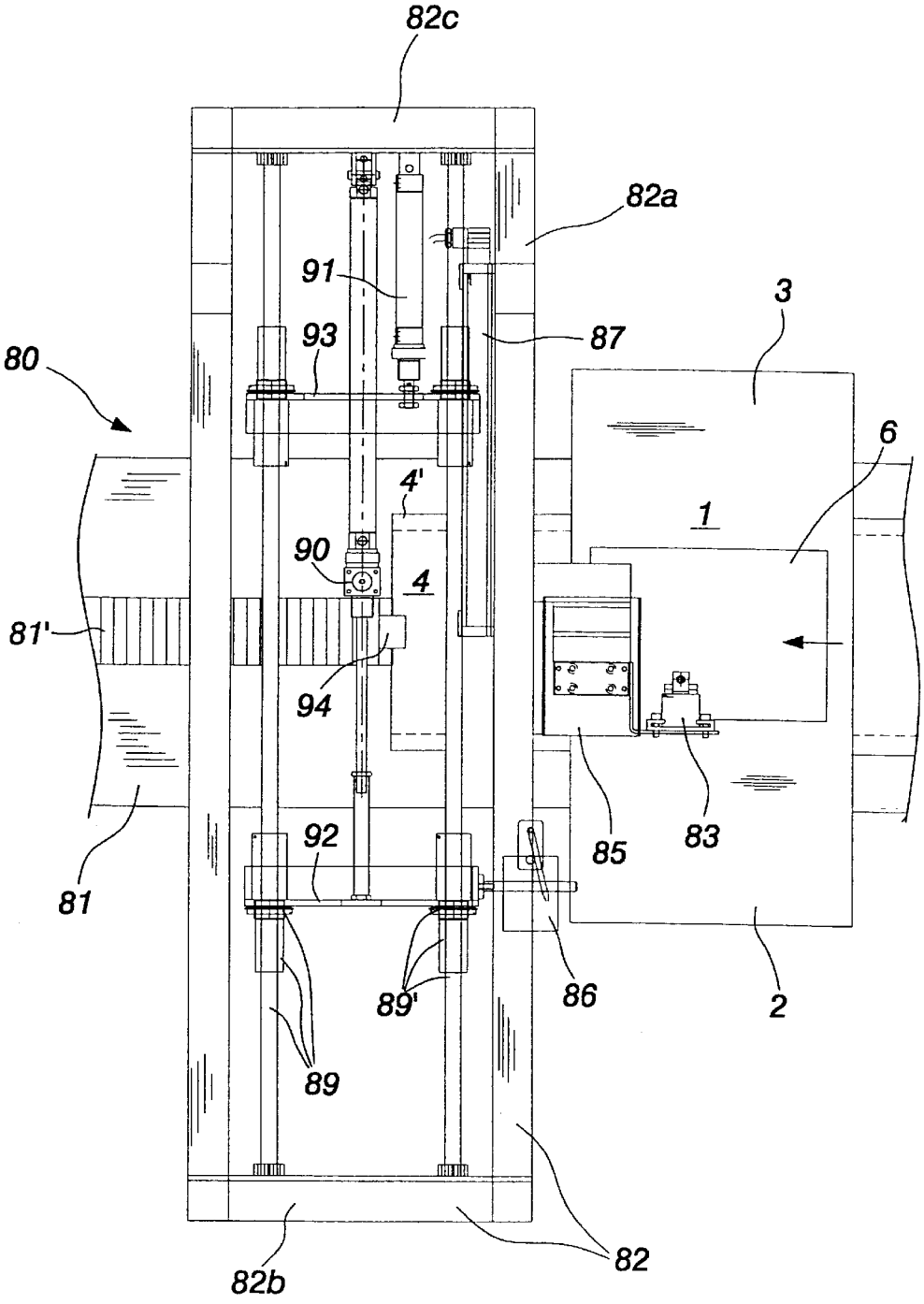

After placing a desired consignment onto the package blank 1, said package blank 1, along with its consignment, is carried by means of a conveyor 81' included in a packaging line 81, 81' to a second measuring station 80 equipped with second measuring elements. This measuring station is depicted in FIGS. 10, 11 and 12. The packaging line conveyor 81' is provided with clamps 94 for pulling the package blank 1 and a consignment present on top of it along the packaging line, comprising a conveyor frame section 81, on top of which the package blank 1 is sliding, and a mobile conveyor belt section 81' with its clamps 94.

The measuring station 80 comprises an immobile skeleton 82 provided with third measuring elements, or elements 83, 84, 85 measuring the height of a consignment. The skeleton is also provided with elements 87, 87' identifying an edge 4' of the outer flap of a package blank. The elements measuring the height of the consignment 6 are mounted on one frame member 82*a* of the measuring station skeleton 82, positioned transversely to the travel direction of the packaging line above the conveyor 81'. These elements include a piston-rod equipped cylinder 84 mounted on the frame member 82*a*, the bottom end of which is fitted with a sensor 85 for detecting the top surface of the consignment 6. The cylinder 84 has the position of its piston rod monitored preferably means of a linear sensor 83 set in connection with the piston rod.

Between spaced-apart frame members 82*b* and 82*c* of the measuring station skeleton 82 are fitted slide bars 89, 89', which extend laterally to the travel direction of the conveyor 81' and are provided with slide bearings. Adapted to be movable with the slide bearings are an adhesive feed unit 86, as well as a detector 87' for the edge 4' of the outer flap 4 of the package blank 1, both located above the laterally opposite edges of the package blank 1.

The slide bars 89, 89' are provided with four slide bearings which are linked to move pairwise on two movable walls 92, 93, the separate movements of the movable walls 92, 93, and hence those of the adhesive feed unit 86 and the detector 87', being produced by means of piston-rod equipped cylinders 90, 91. The cylinders 90, 91 are secured to the frame member 82*c*, while the piston rods of the cylinders are attached to the walls 92, 93. The position of the vertical wall 93, i.e. the position of the detector 87', is monitored by means of a linear sensor 87 preferably mounted on the frame member 82*a*. Thus, the linear sensor 87 and the detector 87', present at different levels, are connected by means of an upright strut 88, whereby an element monitoring the position of the linear sensor 87 maneuvers coincidentally with the vertical wall 93.

As the packaging line conveyor 81' pulls along the package blank 1 and the consignment 6 on top of the same, one 4 of the outer flaps of the package blank 1 is the first to arrive at the second measuring station 80. When the leading edge of the outer flap 4 has passed the edge detector 87' in the advancing direction, the edge detector 87' is pushed by the cylinder 91 in this embodiment to the right, when viewing the measuring station 80 from the front (FIG. 11).

As the detector 87' recognizes a boundary line between the packaging line frame or housing 81 and the edge 4' of the outer flap 4 (e.g. as a result of a different reflectivity of the surfaces), the cylinder 91 stops and the information given by the linear sensor 87 about the position of the detector 87' is automatically stored in a programmable logic. On the basis of this positional information, the adhesive feed unit 86 is driven by means of the cylinder 90 to a correct lateral position in line with the side edge of the inner flap 2 of the package blank 1 advancing along the line 81, 81'. This is based on the fact that the outer flap 4 of the blank 1 has a width which always correlates to that of the inner flaps 2 and 3. While the package blank 1 advanced along the line 81, 81' underneath the adhesive feed unit 86, the adhesive will be applied to the surface of the inner flap 2 in the proximity of its side edge.

While applying adhesive to the inner flap 2 adjacent to its side edge, the consignment 6 on top of the package blank 1 is also measured for its height $h_1$ (see FIG. 24, at VI) by means of a switch 85 fitted in connection with the piston rod of a cylinder 84, preferably a mechanical plate-like tumbler switch, and a linear sensor 83. The switch is lowered by means of the piston rod on top of the consignment 6, the switch 85 having its unsupported portion moving upwards, as shown by a double-arrow in FIG. 11. When the piston rod reaches a sufficiently low level, the piston rod motion is stopped by the action of the switch 85, the linear sensor 83 mounted in connection with the piston rod automatically recording the position of the piston rod, i.e. the height of the consignment 6, in a programmable logic. The switch 85 is sufficiently responsive in its movements not to dislodge the consignment on top of the package blank 1 as a result of coming to contact with the consignment 6 and, thus, the height measurement can be made even as the consignment is moving.

Figure 14:
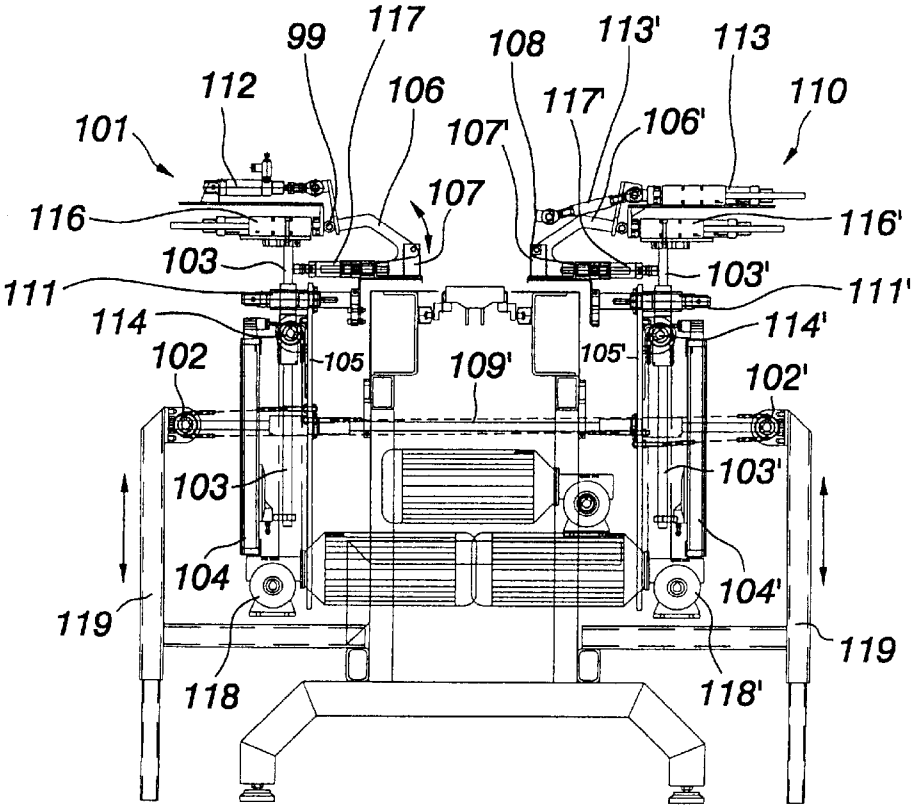
Figure 13:
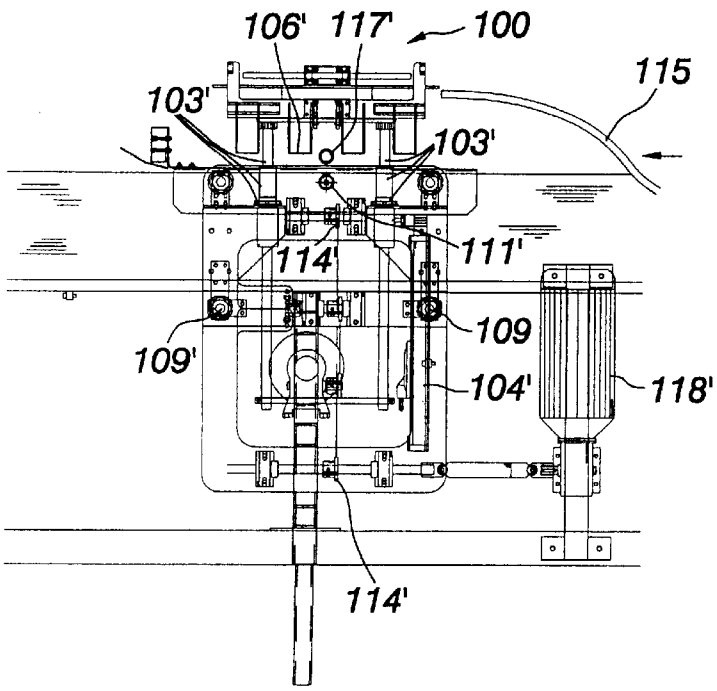
FIGS. 13; 14 and 15 show a folding station 100 for the inner flaps of a package blank in elevation, direction of line, and plan view, respectively.
Figure 15:
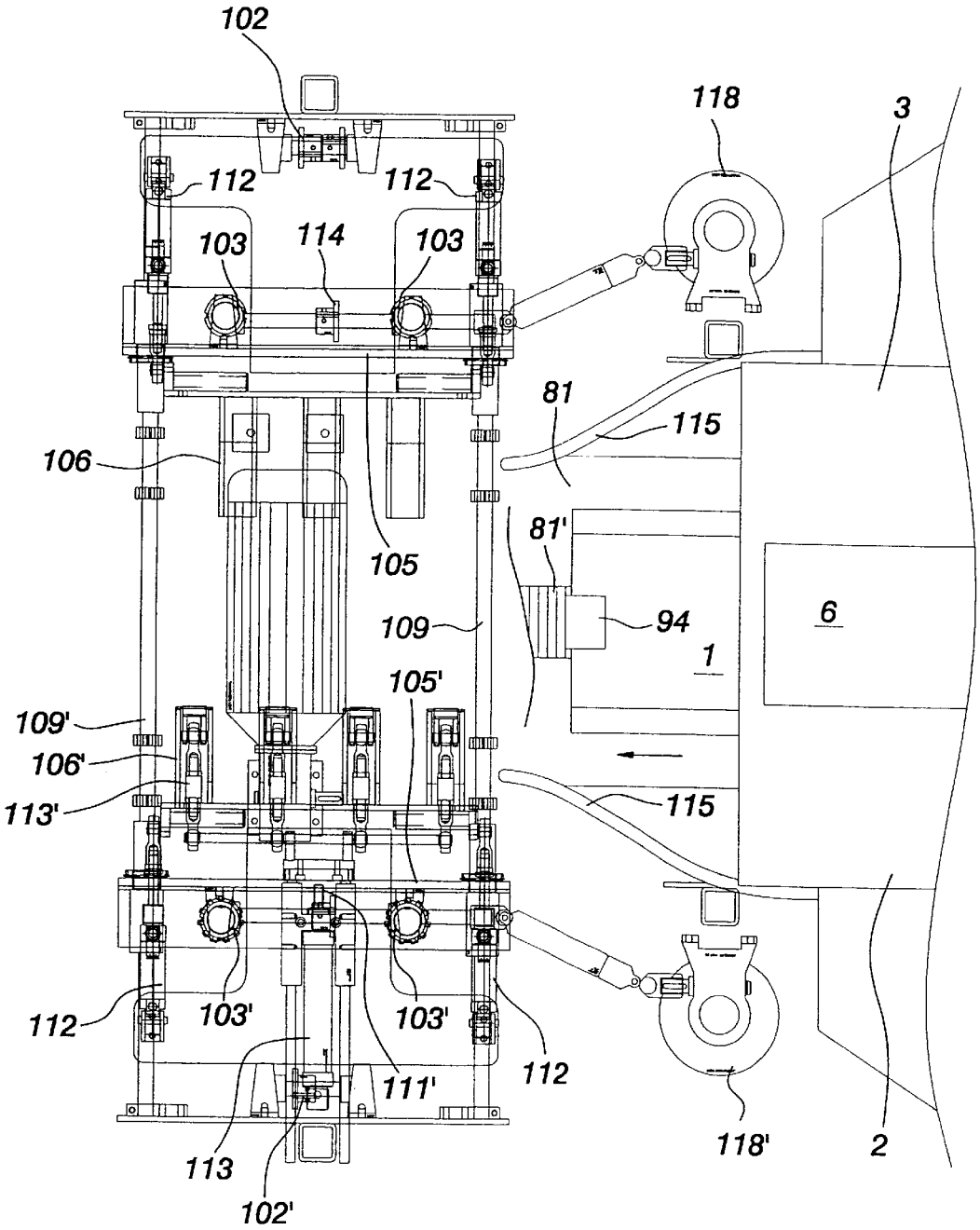

From the measuring station 80 the packaging blank 1 with its consignment is carried by means of the conveyor 81' to a folding station 100 for the inner flaps 2 and 3. The folding station 100 is depicted in FIGS. 13, 14 and 15.

The folding station 100 includes elements 101 for folding the lateral inner flap 3 of the package blank 1 on top of the consignment 6, as well as elements 110 for folding the opposite lateral inner flap 2 of the package blank 1 on top of the consignment 6 and the inner flap 3. The principle for maneuvering these elements 101, 110 laterally relative to the advancing direction of the conveyor is the same as that applied for moving the vertical walls 21, 21' of the supply station 20. There are immobile spaced-apart abutment walls which are fitted below the conveyor 81' with sprockets 102, 102', around which are extended chains (shown in FIG. 14) attached by their ends to movable walls 105, 105'. The pull applied to the movable walls by means of the chains results in coincidental movements of the movable walls towards or away from each other. The pull is preferably created by means of a separate motor used for driving the sprocket 102'. Like the supply station 20, the folding station 100 is also has its movable walls 105, 105' traveling along slide bars 109, 109' in the direction lateral to the advancing direction of the conveyor 81'. The movable walls 105, 105' are connected by means of intermediary guides 111, 111' to the respective movement of the movable walls 105, 105' is transmitted as such to the respective folding elements 101, 110.

The position of the folding elements 101, 110 in lateral direction is determined on the basis of positional information received from the edge detector 87' of the second measuring station 80 and regarding the edge 4' of the package blank 1. The position of the folding elements 101, 110 is monitored preferably in an indirect manner by means of a linear sensor (not shown) mounted on the movable wall 105'.

The folding elements 101, 110 are capable of vertical adjustment which is accomplished by means of vertically journalled slide bars 103, 103', the folding elements 101, 110 being secured to the upper end thereof. The vertical movement is achieved by means of motors 118, 118', which use the action of a chain to drive sprockets 114, 114' mounted on the top and bottom sections of the movable walls 105, 105'. This assembly hoists or lowers a frame structure 119 supporting the entire folding mechanism 101, 110, said frame structure moving along the side bars 103, 103' set in a substantially vertical position.

As the package blank 1 with its consignment 6 is pulled by the conveyor 81' and arrives in the folding and bending station 100 for the inner flaps 2, 3 of the package blank, the inner flaps 2 and 3 presently in an open position are folded during the transfer to a substantially upright position. This is preferably effected by means of guides 115, which are preferably constituted by elongated bars extending from alongside the frame 81 of the conveyor 81' over to the top of said frame. At the same, the folding elements 101, 110 of the folding and bending station 100 are automatically subjected to vertical and lateral adjustments which are consistent with the consignment 6 and blank 1 received in the station 100.

As soon as the upright-folded inner flaps 2 and 3 of the consignment 6 have advanced in between the folding elements 101, 110, the conveyor 81' stops. The bottom edge of the inner flaps 2 and 3 is pressed from the height of the consignment more tightly against the consignment 6 by means of clamps 107, 107' mounted on the piston rod ends of auxiliary cylinders 117, 117'. At the same time, the inner flap 3 is bent against the substantially flat top surface of the consignment 6. This is achieved by means of a press 106, which is mounted with a reversal link 99 on the piston rod end of a supplementary cylinder 116 and is mobile in a direction lateral to the travel direction of the conveyor 81'. The final folding of the inner flap 3 against the consignment 6 is effected through the action of the piston rod of a cylinder 112 arranged in connection with the press 106 and said articulation 99. Thus, the press 106 moves around said articulation 99 for pressing the inner flap 3 against the consignment 6. Respectively, a press 106' moves in an articulated fashion at the piston rod end of a supplementary cylinder 116' while bending the inner flap 2 by means of a cylinder (not shown) towards the inner flap 3 folded on top of the consignment 6. The presses 106, 106' accommodate in spaces between the clamps 107, 107' and are thereby freely movable relative to each other. Above the press 106', as an extension thereof, is mounted a supplementary press 108 for pressing the inner flap 2 in lateral direction over a wider range. This is to make sure that the adhesive applied adjacent to the edge of the inner flap 2 presses tightly against the inner flap 3, and the inner flap 2 adheres by its bonding to the inner flap 3. The supplementary press 108 has its action controlled by means of a cylinder 113, as well as an articulated arm 113' linked to the cylinder 113. There may be several articulated arms arranged side by side in the conveyor advancing direction.

After this, the elements involved in bending the inner flaps 2 and 3 release the package blank 1 and the consignment 6, whereby the conveyor 81' carries the package blank 1 with its consignment to a turning station for the package blank 1. In the turning station, the package blank 1 is turned through 90° relative to the previous advancing direction.

Figure 16:
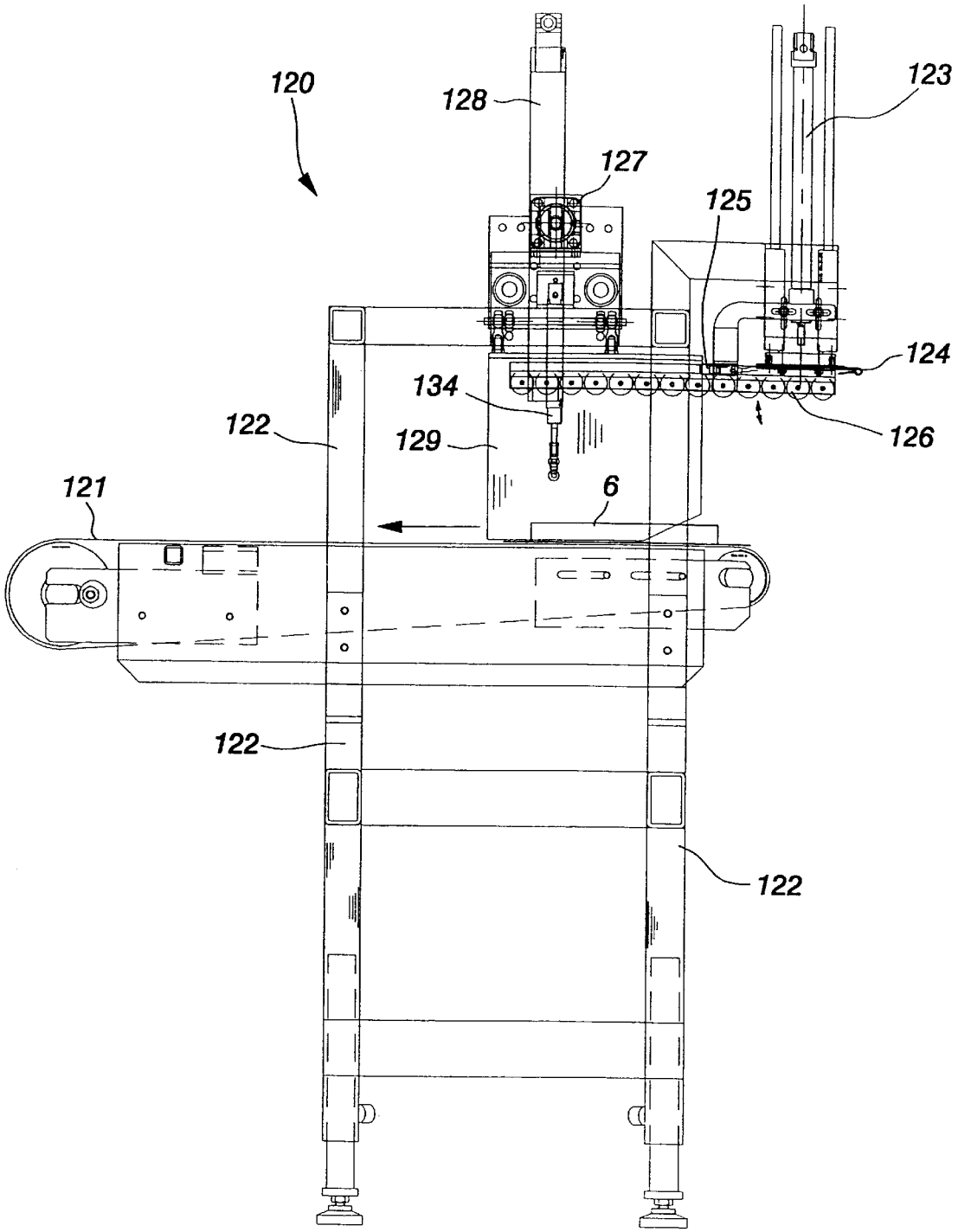
FIGS. 16, 17 and 18 show a third measuring station 120 in elevation, direction of line and plan view, respectively. The third measuring station 120 is assigned for measuring a semi-finished package with regard to its height $h_2$ and width $L_2$.
Figure 17:
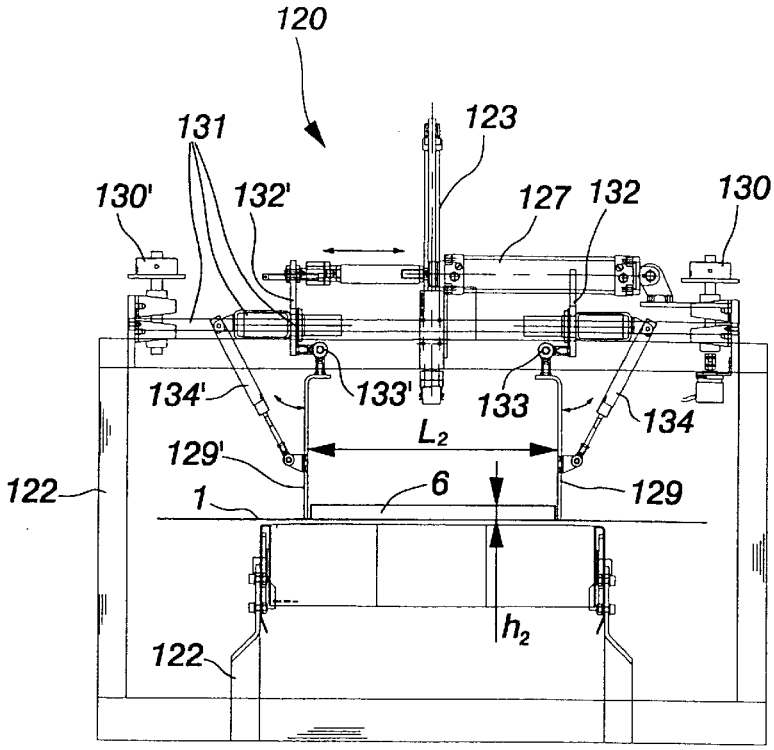
Figure 18:
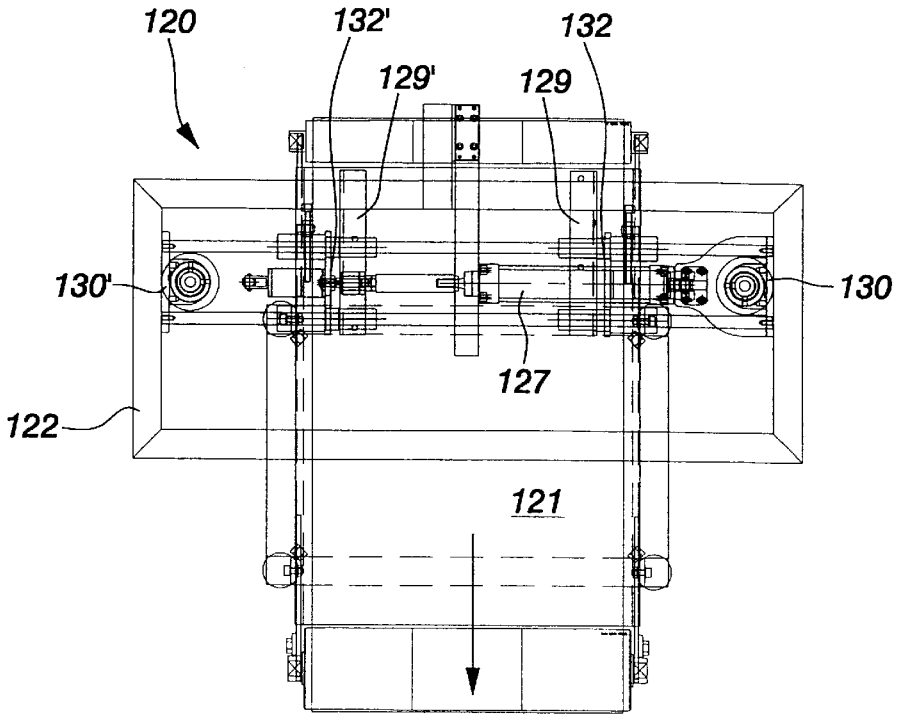

After turning the travel direction, the package blank 1 with its consignment is brought to a third measuring station 120 along a conveyor belt 121 shown in FIGS. 16, 17 and 18. This measuring station is used for measuring the consignment 6 and the inner flaps 2 and 3 folded therearound for a total height $h_2$ thereof (see FIG. 24, at VII), as well as the consignment 6 for its width $L_2$ lateral to the travel direction of the conveyor belt 121. If the inner flaps 2 and 3 are wider than the consignment 6, the dimension $L_2$ matches the width of the inner flaps 2 and 3.

The measurement of the height $h_2$ is effected by means of fourth measuring elements mounted on a frame 122 of the conveyor belt and the measuring mechanism, said elements including a cylinder 123 mounted in an upright position on the frame 122 above the conveyor belt 121. The cylinder 123 has its bottom end preferably fitted with a roller assembly 126 pivotable by means of a hinge 124. The roller assembly 126 is provided with a switch 125, preferably a mechanical switch, for identifying the position of the roller assembly 126 moving around the hinge 124. The vertical position of the cylinder 123 and, hence, that of the roller assembly 126 as well, is monitored preferably by means of a linear sensor 128.

When the consignment 6 has come to a stop in line with the measuring station 120, the roller assembly 126 lies substantially above the consignment 6, as shown in FIG. 16, yet in such a way that one of its ends has pivoted about the hinge 124 to a position lower than the end closer to the hinge 124. When the cylinder 123 makes a move to lower the roller assembly 126 against the consignment 6 and the inner flaps 2 and 3, the roller assembly 126 shall pivot around the hinge 124 until said roller assembly 126 reaches a substantially horizontal position. At this point, the mechanical switch 125 in connection with the roller assembly 126 shifts its position, as a result of which the cylinder 123 stops and the positional information possessed by the linear sensor 128 is stored automatically in the memory of a programmable logic. Thus, this positional information matches the total height $h_2$ of the consignment 6 and the inner flaps 2 and 3.

The frame 122 is also provided with elements for measuring the consignment 6 for its width $L_2$ lateral to the travel direction of the conveyor belt 121. These elements include movable walls 132, 132', journalled upon slide bars 131, 131' which are mounted transversely above the conveyor belt 121. At the bottom section thereof, the movable walls 132, 132' are linked by way of articulations 133, 133' to abutment plates 129, 129'. The abutment plates are pivoted around the articulations 133, 133' by means of cylinders 134, 134', having the top ends thereof articulated to laterally extending extension members mounted on the outer sides of the movable walls 132, 132' and having the bottom ends of their piston rods articulated to the outer walls of the abutment plates 129, 129'. The movable walls 132, 132' are maneuvered the same way as the movable walls 22, 22' of the alignment and centering station 10. The piston rod of a cylinder 127 secured to one of the walls, in this case to the wall 132', manipulates the wall 132' upon the guides 131, 131', thereby manipulating also the abutment 129, 129' move coincidentally, the coincidental or concurrent movements thereof are accomplished by means of chains (not shown) extended around sprockets 130, 130' and having the ends thereof secured to the movable walls 132, 132'. The operating principle for manipulating the movable walls is described in more detail with reference to the alignment and centering station 10.

When the abutment plates 129, 129' are driven along the guides 131, 131' against the edges of the inner flaps 2 and 3, or respectively against the consignment 6, in case the width of a consignment exceeds that of the inner flaps 2 and 3, such plates are in an upright position, as depicted in FIG. 17. Thus, the consignment 6 is retained between the bottom edges of the abutment plates 129, 129'. The abutment plates are still moved towards each other, the articulations 133, 133' enabling the top sections of the abutment plates 129, 129' to move towards each other, while the bottom edges remain stationary when pressing against the edges of the inner flaps 2 and 3 or the edges of the consignment 6. Thus, the top sections of the abutment plates 129, 129' come closer to each other and the piston rods of the cylinders 134, 134' retract inward. The cylinders 134, 134' are provided with sensors (not shown) for detecting a distance preset for the piston rod to travel. As soon as the piston rods have covered the discussed preset distance (i.e. as the abutment plates have reclined from an upright position to a certain angle), this is detected by aforesaid sensors and, thus, the cylinder 127 comes to a stop. The cylinder 127 is linked with a linear sensor (not shown) for monitoring the cylinder 127 with regard to the position of its piston rod. From this linear sensor, the logic can be stored with information about the piston rod position of the stopped cylinder 127, which corresponds to the width $L_2$.

After the measurements, the consignment 6 is carried along a conveyor belt to a sizing unit 139, wherein the package blank 1 has adhesive applied to the lateral edge area of its second outer flap 5. The sizing unit 139 has a structural and operating principle which is essentially identical to the structure and operation of the sizing unit 86 of the inner flap 2 and, thus, not described in further detail in this conjuncture.

The consignment 6 is carried from the sizing unit 139 along a conveyor belt to a bending and folding station 140, 160 for the outer flaps 4 and 5. The station 140 is provided with bending elements for bending the outer flaps 4 and 5 to an upright position, as shown at VIII in FIG. 24, and the station 160 is provided with folding elements for folding the outer flaps 4 and 5 onto the inner flaps 2 and 3 bent on top of the consignment, as shown at IX in FIG. 24.

Figure 19:
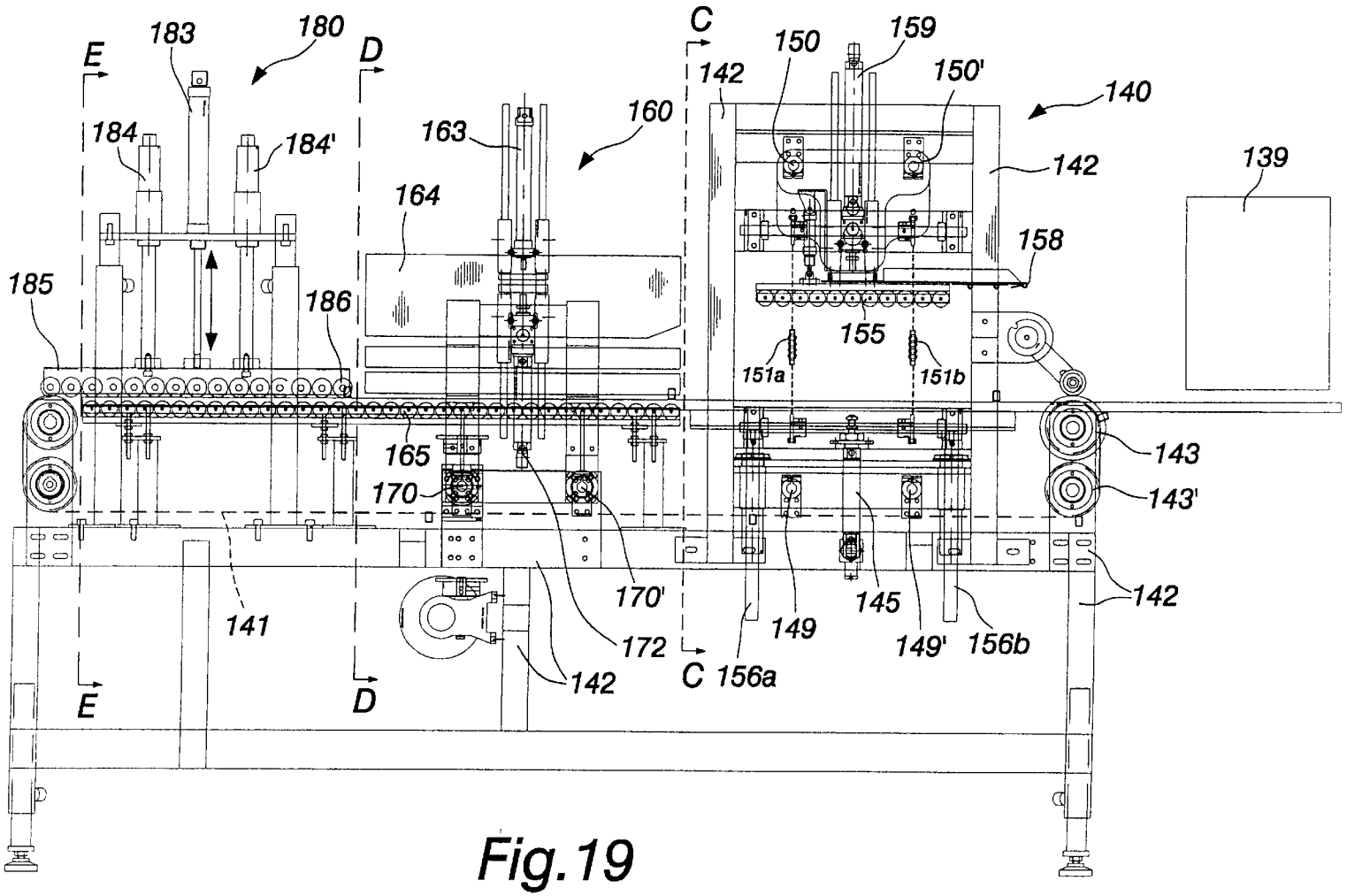
FIGS. 19, 20 and 21 show a bending station 140 for the outer flaps in elevation, plan view, and direction of line (from the front), respectively. In addition, FIGS. 19 and 20 visualize a folding station 160 and a press station 180 for the outer flaps, respectively in elevation and plan view.
Figure 20:
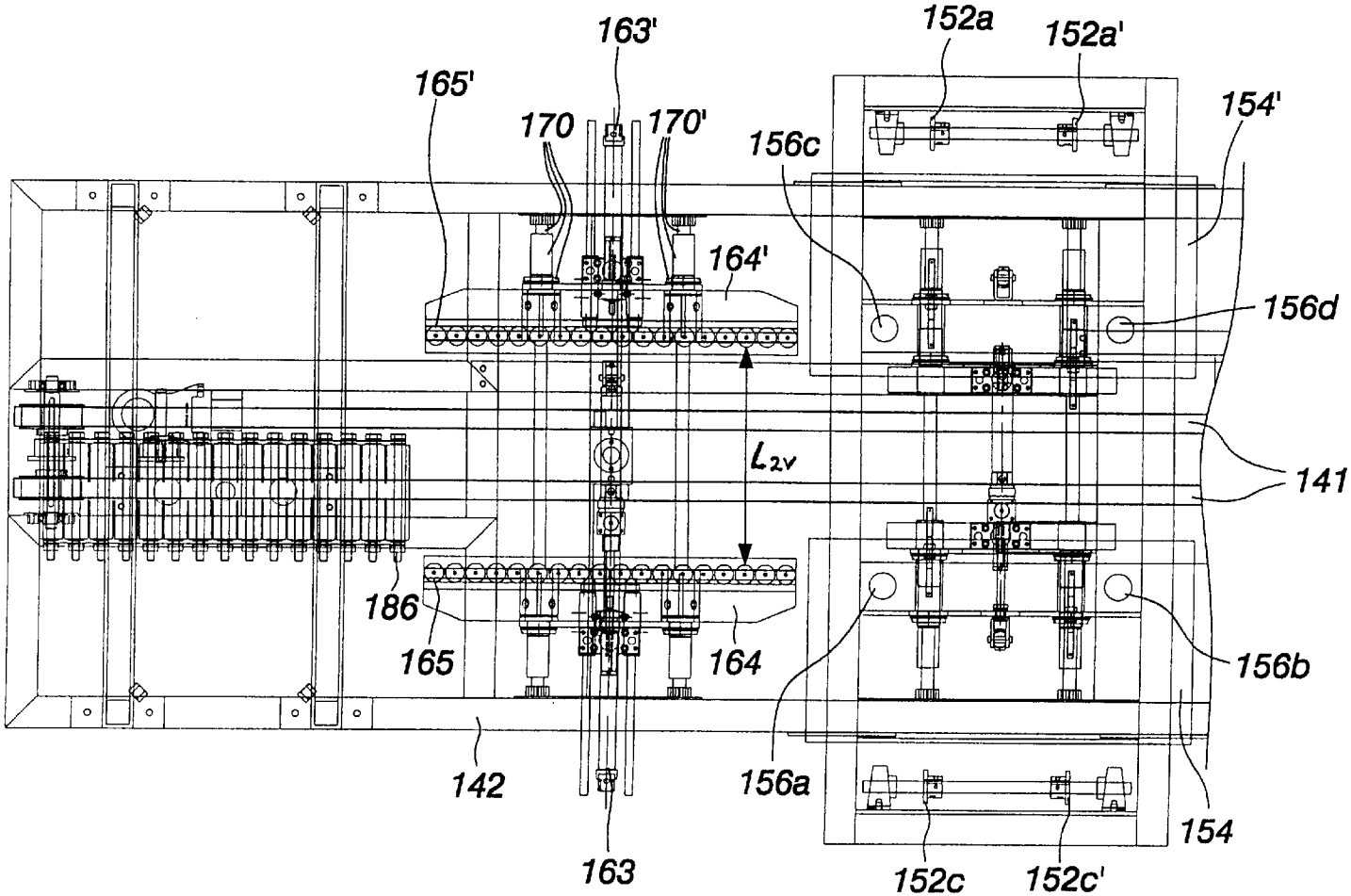
Figure 21:
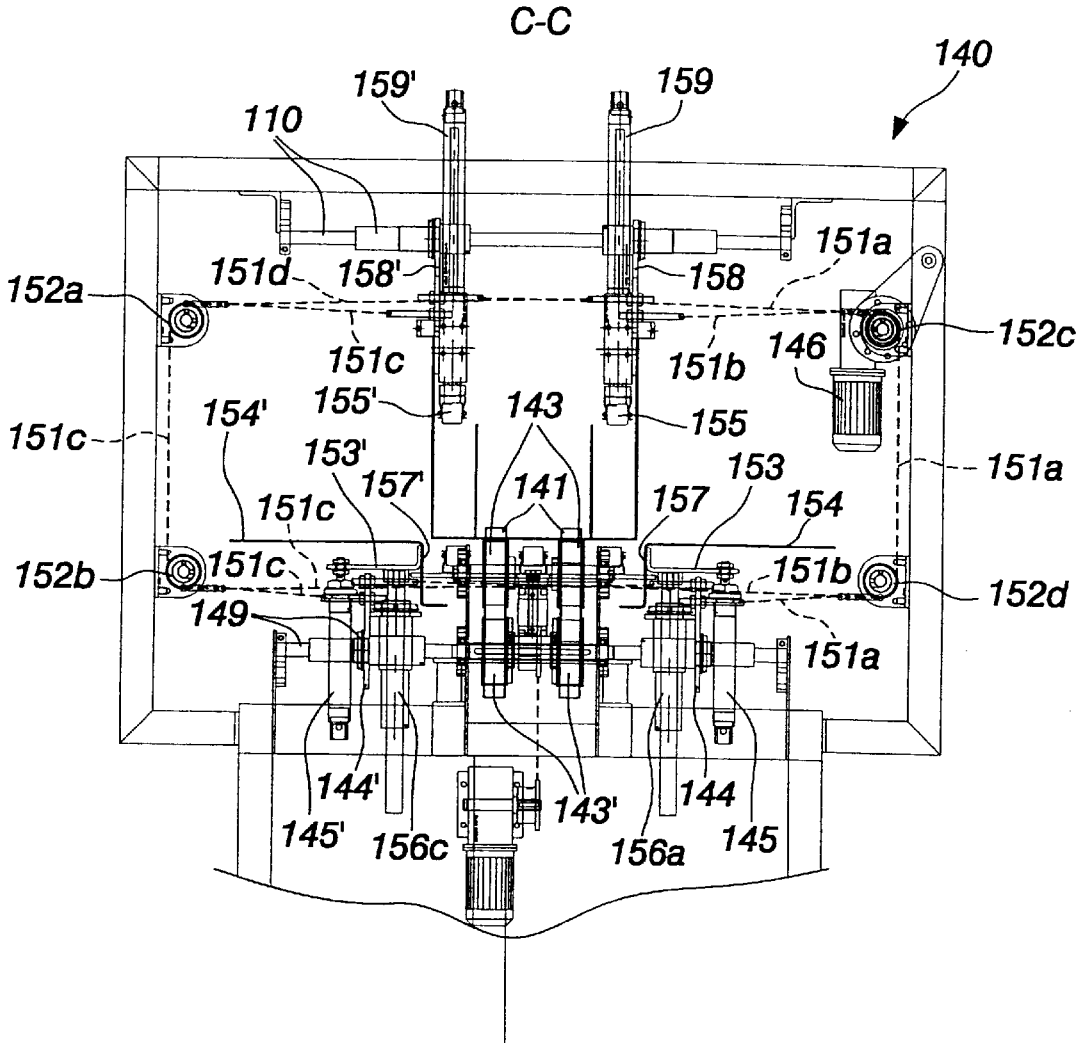

The bending station 140 for the outer flaps is depicted in FIG. 19 in a side view, in FIG. 20 in a plan view, and in FIG. 21 in a front view. The station 140 is provided with pairs of guides 149, 149' and 150, 150', mounted on a frame 142 of a conveyor 141 transverse to its traveling direction. As far as these pairs of guides are concerned, 149, 149' is positioned below the conveyor 141, and 150, 150' is positioned above the conveyor 141. Adapted to be movable along the lower pair of guides are movable walls 144, 144' on either side of the conveyor. Supported by each movable wall, the top portion of said walls is fitted with pairs of vertical guides 156*a*, 156*b* and 156*c*, 156*d*. Each pair of vertical guides is connected by means of spacer plates 153, 153' to cylinders 145, 145' set in an upright position in view of maneuvering the pairs of guides. To the spacer plates 153, 153' are attached actual bending plates 154, 154', which are substantially flat and maneuver in vertical direction as the piston rods of the cylinders 145, 145' are moving. The conveyor-facing sides of the bending plates 154, 154' are provided with vertical walls 157, 157', whereby, when lifting up the plates 154, 154' set at a certain distance from each other, the consignment 6 will be retained between these plates. At the same time, the vertical walls 157, 157' bend the outer flaps 4 and 5 of the package blank 1 to an upright position.

Adapted to be movable along the upper-pair of guides 150, 150' are vertical cylinders 159, 159' used for lowering presses 155, 155' against the consignment 6. The movable walls 144, 144' and 158, 158' are connected to each other by means of chains 151*a*, 151*b*, 151*c*, 151*d* extending around eight sprockets 152 in such a way that the adjustment of vertical walls 157, 157' at a desired distance from each other will result in the presses 155, 155' being set at a correct distance from each other, as well. This adjustment is performed by using for example a motor 146 to drive sprockets 152*c*, 152*c'* from which the movement is transmitted by way of the chains as a pulling action to the movable walls 144, 144', 158, 158'.

Figure 22:
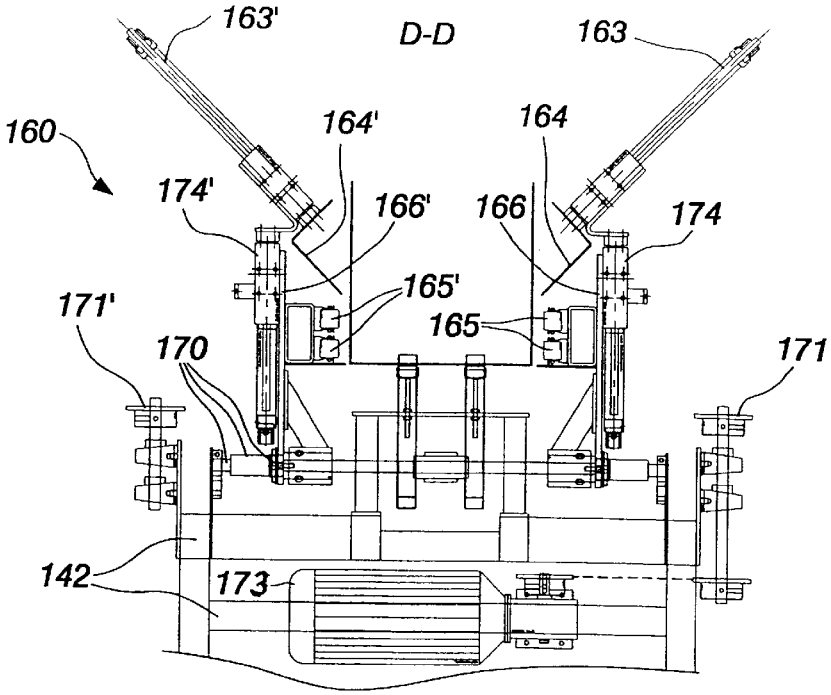
FIG. 22 shows the folding station 160 for the outer flaps in the direction of line.
Figure 23:
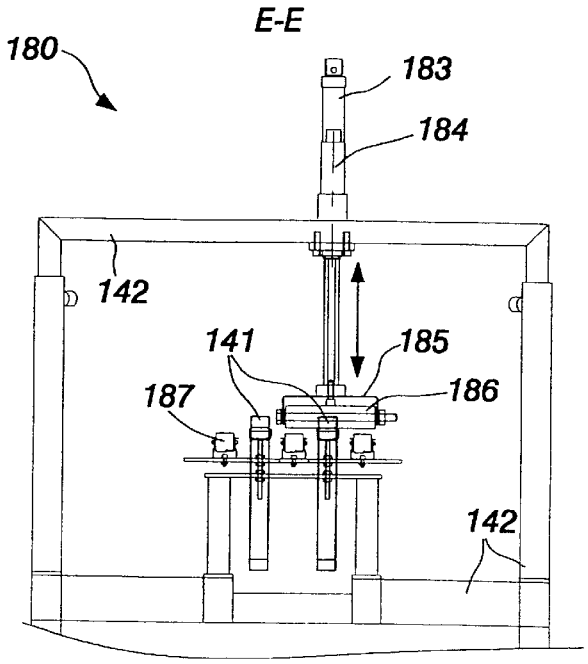
FIG. 23 shows a press station 180 in the direction of line.

Thereafter, the package blank 1, with its outer flaps 4 and 5 bent to a vertical position, is carried along the conveyor 141 to the folding station 160 of the outer flaps, depicted in FIGS. 19, 20 and 22. In this station, the outer flaps 4 and 5 are folded on top of the inner flaps 2 and 3 of the consignment 6, the package blank 1 constituting a package wrapped around the consignment 6. This is performed by means of folders 164, 164', extending diagonally downwards and movable towards the median of the conveyor 141.

The folders 164, 164' are automatically adjustable in terms of their vertical and lateral position on the basis of measuring results obtained at the third measuring station 100. On either side of the conveyor 141, at a distance from each other, there are arranged walls 166, 166' movable along slide bars 170, 170'. Secured by the ends thereof to the movable walls 166, 166' are chains (not shown), which are adapted to maneuver the walls 166, 166' through the intermediary of sprockets 171, 171' drivable by means of a motor 173. The movable walls 166, 166' have their inside surfaces fitted with rollers 165, 165' in such a way that, when the movable walls have a relative distance therebetween which matches the width $L_2$ of the consignment 6, the rollers 165, 165' are pressing the upward bent outer flaps 4 and 5 in lateral direction lightly against the consignment 6.

The movable walls 166, 166' have their outside surfaces fitted with cylinders 174, 174', whose piston rods are working essentially perpendicularly up and down. The cylinders 174, 174' have the ends of their piston rods provided with diagonally installed further cylinders 163, 163', which travel together with the piston rods of the cylinders 174, 174'. The cylinders 163, 163' have the ends of their piston rods fitted with the actual folders 164, 164'. Thus, the folders 164, 164' maneuver in lateral direction along with the movable walls 166, 166', and in vertical direction said folders travel along with the piston rods of the vertical cylinders 174, 174' attached to the movable walls 166, 166'.

The package blank 1, with the consignment 6, travels along the conveyor 141 between the roller assemblies 165, 165' of the folding station 160 of the outer flaps. The conveyor stops as the consignment 6 gets in line with the folders 164, 164' in the conveyor advancing direction. At this point, the piston rod of the cylinder 163 and the folder 164 move diagonally down towards the consignment 6 and the inner flaps 2 and 3. Respectively, the outer flap is bent by means of the folder 164' on top of the folded outer flap 4, the adhesive applied to the edge portion of the outer flap 5 bonding to the outer flap 4.

Thereafter, the piston rods of the cylinders 163, 163' transfer to the initial position and the package containing the consignment 6 advances by means of the conveyor 141 to a press station 180. This station, its frame structure 142 above the conveyor 141, is provided with a vertically positioned, piston-rod equipped cylinder 183, as well as slide bars 184, 184', along which is mounted a press member 185 for a vertical action. The press member 185 includes roll-shaped rollers 186, which are lowered by means of the cylinder 183 against the consignment 6 and the outer flaps wrapped around it. The rollers 186 press the flaps folded on top of the below-moving consignment 6 at a sufficient force for bonding the outer flap 5 with a sufficient strength to the surface of the outer flap 4. After this, the consignment 6 and the package are ready for further handling.

It should further be noted that the elements, such as cylinders 145, 145', 174, 174', and 183, responsible for actions in the station 140, 160, and 180 shown in FIGS. 19 and 20 are preferably monitored by means of linear sensors, not shown in the figures, for the position thereof. The positions are compared with certain height- and width-related information measured from the third measuring station 120 for automatically controlling a proper operating position for the elements providing the actions.

The above description is considered that of the preferred embodiments only. Modification of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A packaging apparatus for wrapping flat articles in a package blank, the package blank including inner flaps initially in a closed position and outer flaps, said packaging apparatus comprising:

a supply station for supplying package blanks, comprising means for aligning and centering a bundle of package blanks and feed means for delivering the blanks from the bundle one by one onto a packaging line traveling in an advancing direction, the aligning and centering means including walls present on opposite sides of the bundle of package blanks;

an opening mechanism for opening the inner flaps of the package blank;

a supply station for feeding one or more articles onto each package blank;

means for folding and bending the inner flaps around the one or more articles;

means for turning the package blank through 90° relative to the advancing direction; and means for folding and bending the outer flaps around the one or more articles on top of the inner flaps in a bending direction transverse to that of the inner flaps;

wherein the packaging apparatus is provided with first measuring elements for measuring a width of the package blank lateral to the advancing direction, wherein the first measuring elements also align and center the bundle of package blanks during the course of measuring, and wherein the first measuring elements produce a measuring results which automatically controls a distance between the walls of the aligning and centering means.

2. A packaging apparatus as set forth in claim 1, wherein the packaging line is provided upstream of the means for folding and bending the inner flaps with second measuring elements for measuring a height of the one or more articles on the package blank, and wherein the second measuring elements produce a measuring result which automatically controls a position in a vertical direction of the means for folding and bending the inner flaps.

3. A packaging apparatus as set forth in claim 2, wherein the packaging line is provided upstream of the means for folding and bending the outer flaps with third measuring elements for measuring a width of the one or more articles on the package blank in a direction transverse to the advancing direction, or a width of the inner flaps of the package blank folded and bent around the one or more articles, and with fourth measuring elements for measuring a total height of the one or more articles and the inner flaps folded and bent therearound, and wherein the third and fourth measuring elements produce a measuring result which automatically controls a relative distance between the means for folding and bending the outer flaps and a position in a vertical direction of the means for folding and bending the outer flaps.

4. A packaging apparatus as set forth in claim 2, wherein the packaging line is provided upstream of the means for folding and bending the inner flaps with an edge detector for identifying a side edge of the package blank, and wherein a detection provided by the edge detector about the package blank with regard to a position of the side edge automatically controls a distance between the means for folding and bending the inner flaps.

5. A packaging apparatus as set forth in claim 4, wherein the packaging line is provided upstream of the means for folding and bending the outer flaps with third measuring elements for measuring a width of the one or more articles on the package blank in a direction transverse to the advancing direction, or a width of the inner flaps of the package blank folded and bent around the one or more articles, and with fourth measuring elements for measuring a total height of the one or more articles and the inner flaps folded and bent therearound, and wherein the third and fourth measuring elements produce a measuring result which automatically controls a relative distance between the means for folding and bending the outer flaps and a position in a vertical direction of the means for folding and bending the outer flaps.

6. A packaging apparatus as set forth in claim 1, wherein the packaging line is provided upstream of the means for folding and bending the inner flaps with an edge detector for identifying a side edge of the package blank, and wherein a detection provided by the edge detector about the package blank with regard to a position of the side edge automatically controls a distance between the means for folding and bending the inner flaps.

7. A packaging apparatus as set forth in claim 6, wherein the packaging line is provided upstream of the means for folding and bending the outer flaps with second measuring elements for measuring a width of the one or more articles on the package blank in a direction transverse to the advancing direction, or a width of the inner flaps of the package blank folded and bent around the one or more articles, and with third measuring elements for measuring a total height of the one or more articles and the inner flaps folded and bent therearound, and wherein the second and third measuring elements produce a measuring result which automatically controls a relative distance between the means for folding and bending the outer flaps and a position in a vertical direction of the means for folding and bending the outer flaps.

8. A packaging apparatus as set forth in claim 1, wherein the packaging line is provided upstream of the means for folding and bending the outer flaps with second measuring elements for measuring a width of the one or more articles on the package blank in a direction transverse to the advancing direction, or a width of the inner flaps of the package blank folded and bent around the one or more articles, and with third measuring elements for measuring a total height of the one or more articles and the inner flaps folded and bent therearound, and wherein the second and third measuring elements produce a measuring result which automatically controls a relative distance between the means for folding and bending the outer flaps and a position in a vertical direction of the means for folding and bending the outer flaps.

9. A packaging apparatus for wrapping one or more articles in a package blank to form a finished package, the package blank including a flat panel having inner flaps initially in a closed position and outer flaps, the packaging apparatus comprising:

a supply station for supplying package blanks including walls for aligning and centering a bundle of package blanks and a feeding mechanism for delivering the blanks from the bundle one by one onto a packaging line traveling in an advancing direction, the walls configured to be present on opposite sides of the bundle of package blanks;

an opening mechanism for opening the inner flaps of the package blank;

a supply station for feeding one or more articles onto each package blank;

arms for folding and bending the inner flaps around the one or more articles in a bending direction;

a turning station for turning the package blank through 90° relative to the advancing direction;

panels for folding and bending the outer flaps around the one or more articles on top of the inner flaps in a bending direction transverse to the bending direction of the inner flaps; and first measuring elements for measuring a width of the package blank lateral to the advancing direction;

wherein the first measuring elements align and center the bundle of package blanks during the course of measuring, and wherein the first measuring elements produce a measuring results which automatically controls a distance between the walls of the supply station.

10. A packaging apparatus as set forth in claim 9, wherein:

the packaging line is provided upstream of the arms for folding and bending the inner flaps with second measuring elements for measuring a height of the one or more articles on the package blank; and the second measuring elements produce a measuring result which automatically controls a position in a vertical direction of the arms for folding and bending the inner flaps.

11. A packaging apparatus as set forth in claim 9, wherein:

the packaging line is provided upstream of the arms for folding and bending the inner flaps with an edge detector for identifying a side edge of the package blank; and wherein a detection provided by the edge detector about the package blank with regard to a position of the side edge automatically controls a distance between the arms for folding and bending the inner flaps.

12. A packaging apparatus as set forth in claim 9, wherein:

the packaging line is provided upstream of the panels for folding and bending the outer flaps, the packaging line including second measuring elements for measuring a width of the one or more articles on the package blank in a direction transverse to the advancing direction, or a width of the inner flaps of the package blank folded and bent around the one or more articles, and with third measuring elements for measuring a total height of the one or more articles and the inner flaps folded and bent therearound; and the second and third measuring elements produce a measuring result which automatically controls a relative distance between the panels and a position of the panels in a vertical direction.

* * * * *

UNITED STATES PATENT AND TRADEMARK OFFICE

CERTIFICATE OF CORRECTION

PATENT NO. : 6,510,670 B1
DATED : January 28, 2003
INVENTOR(S) : Tarmo Janhonen

It is certified that error appears in the above-identified patent and that said Letters Patent is hereby corrected as shown below:

Column 3,
Line 31, after "belt" insert -- 11. --.

Column 14,
Line 3, "results" should be -- result --.

Column 16,
Line 9, "results" should be -- result --.

Signed and Sealed this

Fifteenth Day of July, 2003

JAMES E. ROGAN
*Director of the United States Patent and Trademark Office*